US008469420B2

(12) United States Patent
Mills et al.

(10) Patent No.: US 8,469,420 B2
(45) Date of Patent: Jun. 25, 2013

(54) SPREADER SPACING DEVICE

(75) Inventors: Robert Arthur Mills, Lancashire (GB); Qifan Bao, Shanghai (CN); Ghee Hua Ng, Singapore (SG); Zhan Min Tong, Singapore (SG)

(73) Assignee: Robert Arthur Mills, Lancashire (GB)

( * ) Notice: Subject to any disclaimer, the term of this patent is extended or adjusted under 35 U.S.C. 154(b) by 554 days.

(21) Appl. No.: 12/301,943

(22) PCT Filed: May 22, 2007

(86) PCT No.: PCT/SG2007/000143

§ 371 (c)(1),
(2), (4) Date: Jul. 19, 2010

(87) PCT Pub. No.: WO2007/136352

PCT Pub. Date: Nov. 29, 2007

(65) Prior Publication Data

US 2011/0123257 A1 May 26, 2011

(30) Foreign Application Priority Data

May 22, 2006 (SG) ..... 200603309-6
Mar. 12, 2007 (WO) ..... PCT/CN2007/000774

(51) Int. Cl.
*B66C 1/66* (2006.01)

(52) U.S. Cl.
USPC ..... 294/81.1; 294/81.4

(58) Field of Classification Search
USPC . 294/81.1, 81.2, 81.21, 81.4, 81.53; 212/316, 212/323
See application file for complete search history.

(56) References Cited

U.S. PATENT DOCUMENTS

| | | | | |
|---|---|---|---|---|
| 3,536,351 | A * | 10/1970 | Zweifel et al. | 294/81.1 |
| 3,747,970 | A | 7/1973 | Fathauer et al. | |
| 7,861,872 | B2 * | 1/2011 | Ng et al. | 212/316 |
| 7,918,354 | B2 * | 4/2011 | Shan | 212/323 |
| 2003/0189348 | A1 * | 10/2003 | Lindstrom | 294/81.53 |
| 2007/0296228 | A1 * | 12/2007 | Mills et al. | 294/81.1 |
| 2009/0115212 | A1 * | 5/2009 | Ng et al. | 294/81.2 |

FOREIGN PATENT DOCUMENTS

| | | | |
|---|---|---|---|
| WO | WO 03/099699 | A1 | 12/2003 |
| WO | WO 03/104132 | A1 | 12/2003 |
| WO | WO 2005/090223 | A1 | 9/2005 |

* cited by examiner

*Primary Examiner* — Dean Kramer
(74) *Attorney, Agent, or Firm* — Alston & Bird LLP

(57) ABSTRACT

An engagement assembly (1) for mounting to a first head block (2) so as to engage a Second head block (5), the assembly comprising: at least one mounting bracket for mounting the assembly to the first head block (2); a plurality of extendable members each connected at a first end to the at least one mounting bracket, a second opposed end of each extendable member being extendable away from the first head block; a plurality of engagement portions (50 A,B) in communication with the second ends such that extensions of the second ends consequently extends the engagement portions (25), the engagement portions adapted to engage engagement brackets (30) mounted to the second head block (5), wherein on engagement the engagement assembly permits selective relative movement in the horizontal plane and free relative vertical movement.

43 Claims, 26 Drawing Sheets

| | Inlet A | Inlet B | Inlet C | |
|---|---|---|---|---|
| 170 | 1 | -1 | 1 | |
| 175 | 1 | 0 | -1 | |
| 180 | -1 | 1 | -1 | |
| 185 | 1 | -1 | 0 | |
| 190 | -1 | 1 | 0 | |

275
270
274
281
283
282
8X
4X
4X
305
300
295
275
270
274
276
285B
290
286
280
285A
278
277
2X
X
X
284
255

325
320
265

SPREADER SPACING DEVICE

FIELD OF THE INVENTION

The invention relates to spreaders used for the movement of shipping containers for instance at a container yard for the loading and unloading of containers from a container ship. More specifically the invention relates to head blocks mounted to said spreaders which are used to connect the cables to the spreaders through sheaves, the head blocks being typically detachable from said spreaders. Further still the invention relates to those spreaders and head blocks used for the movement of multiple containers at one time.

BACKGROUND

The economics of processing shipping containers is volume directly proportional to the containers through a shipping yard. To enhance the flow of containers, certain apparatus has been developed whereby two containers may be moved at one time and so at least at this stage doubling the rate of movement of the containers.

For instance, where access to move containers is limited, it is particularly advantageous to use apparatus that will fit within a confined space, such as limited to a single head block and spreader, with apparatus that includes two head blocks and spreaders.

To this end it would be further advantageous if two head blocks could be used for two spreaders engaging two containers and further that the spreaders or head blocks could be separated so as to deal with the two containers as individuals rather than collectively.

A system has been proposed to achieve this involving arms projecting from one head block having ball shaped ends and mounted to a second head block is a mechanical device for engagement that comes together to grip the balls in a pincer-type action, creating a ball joint between the two devices. Thus by activating the arms to move to position and further to have the pincers to move into position also, the head blocks can be engaged and disengaged accordingly.

However, in order to engage the two head blocks, the tolerance for the pincers to engage the balls of the projecting arms is of the order of 50 mm. One can imagine two head blocks having spreaders attached thereto in an outdoor environment where wind can affect the motion of the spreaders. To engage the head blocks within a tolerance of 50 mm would be an extremely difficult activity and certainly time consuming detracting from the benefits offered by the dual head blocks.

Other more complex systems are known such as those having projecting arms formed from parallelogram linkages. Whilst useful said systems are more complex to manufacture and require a greater number of moving parts which could lead to further maintenance.

It would therefore be advantageous to have a head block that could be engaged and disengaged more easily than the above mentioned system.

STATEMENT OF INVENTION

Therefore, in a first aspect the invention provides an engagement assembly for mounting to a first head block so as to engage a second head block, said assembly comprising at least one mounting bracket for mounting the assembly to the first head block; a plurality of extendable members each connected at a first end to the at least one mounting bracket, a second opposed end of each extendable member being extendable away from said first head block; a plurality of engagement portions in communication with the second ends such that extension of the second ends consequently extends the engagement portions, said engagement portions adapted to engage engagement brackets mounted to the second head block, wherein on engagement the engagement assembly permits selective relative movement in the horizontal plane and free relative vertical movement.

In a second aspect, the invention provides a method of engaging a first head block and a second head block, comprising the steps of: extending a plurality of extendable arms mounted at first ends to the first head block towards the second head block, said extendable arms having second ends in communication with a plurality of engagement portions such that extension of the second ends consequently extends the engagement portions; said engagement portions engaging engagement brackets mounted to the second head block; permitting selective relative movement of the head blocks in the horizontal plane and free relative vertical movement.

In a third aspect the invention provides an engagement assembly for mounting to a first head block so as to engage a second head block, said assembly comprising: at least one mounting bracket for mounting the assembly to the first head block; a plurality of telescopically extendable members each connected at a first end to the at least one mounting bracket, a second opposed end of each telescopically extendable member being extendable away from said first head block; a plurality of engagement portions in communication with the second ends such that extension of the second ends consequently extends the engagement portions, said engagement portions adapted to engage engagement brackets mounted to the second head block, wherein; on engagement, relative movement of the head blocks in the horizontal plane is subject to extension of the telescopically extendable members and relative vertical movement is independent of the telescopically extendable members.

In a fourth aspect the invention provides a method of engaging a first head block and a second head block, comprising the steps of: extending a plurality of telescopically extendable arms mounted at first ends to the first head block towards the second head block, said telescopically extendable arms having second ends in communication with a plurality of engagement portions such that extension of the second ends consequently extends the engagement portions; said engagement portions engaging engagement brackets mounted to the second head block; permitting selective relative movement of the head blocks in the horizontal plane and free relative vertical movement.

In a fifth aspect the invention provides an engagement assembly for mounting to a first head block so as to engage a second head block, said assembly comprising:

at least one mounting bracket for mounting the assembly to the first head block;

a plurality of extendable members each connected at a first end to the at least one mounting bracket, a second opposed end of each extendable member being extendable away from said first head block;

said extendable members arranged to extend the respective second ends in the same horizontal plane;

a plurality of engagement portions in communication with the second ends such that extension of the second ends consequently extends the engagement portions, said engagement portions adapted to engage engagement brackets mounted to the second head block, wherein on engagement the engagement assembly permits selective relative movement in the horizontal plane and free relative vertical movement.

In a sixth aspect the invention provides an engagement assembly for mounting to a first head block so as to engage a second head block, said assembly comprising:

at least one mounting bracket for mounting the assembly to the first head block;

a plurality of extendable members each connected at a first end to the at least one mounting bracket, a second opposed end of each extendable member being extendable away from said first head block;

said extendable members capable of extending at least one extendable member whilst maintaining the position of at least one other extendable member;

a plurality of engagement portions in communication with the second ends such that extension of the second ends consequently extends the engagement portions, said engagement portions adapted to engage engagement brackets mounted to the second head block, wherein on engagement the engagement assembly permits selective relative movement in the horizontal plane and free relative vertical movement.

As a broad concept the invention provides for a mechanical device mounted to a first head block which extends to grip a fixed portion of an adjacent second head block, and following engagement permits free relative vertical movement between the head blocks.

The invention has several distinct advantages. First of all by having only one side acting as a device, the complexity of the alignment of the device is lessened by having a single device only. Further, in an embodiment the extension and retraction of the engagement portions may provide for a considerably greater margin for error as engagement may not require a high level of precision compared to the prior art.

Further complexity is removed by realising the hoists supporting the head blocks control vertical movement, and so as the invention permits free relative vertical movement, the assembly won't interfere with this movement and control.

In a preferred embodiment, the mounting bracket may be a single base from which each arm extends or alternatively each arm may have an individual base; either alternative possibly being bolted or welded to the first head block.

In a more preferred embodiment, the assembly may engage the second head block at a convenient appendage of the second head block. Alternatively the second head block may have purpose built brackets for receiving the engagement portions. In a still further preferred embodiment, the engagement portions may be vertical rods mounted to the second head block and further may have one rod per engagement portion. Preferably, there will be two rods to engage with two engagement portions. Alternatively plates may be mounted either by welding or bolting to the second head block having vertical slots inscribed into the plates, said slots adapted to receive the engagement portions.

In an alternative arrangement the assembly may engage the second head block through lugs mounted on the extending arms for engagement with corresponding brackets mounted to the second head block. Further still the brackets may comprise members having vertically aligned channels such that the lugs on insertion within said channels are free to move vertically but are constrained from horizontal movement by said channels.

In a preferred embodiment, there may be two extendable members and further said extension of the extendable members may be through a telescopic action. Alternatively the extension may be achieved through a linkage arrangement. In either case the extension may be achieved through mounting an actuator, for instance a hydraulic, pneumatic or electric actuator, for controlling the extension and subsequent retraction of the extendable members. Further on retraction of the extendable members having disengaged the assembly from the second head block, said extendable members and other portions of the assembly may lie within a planned area of the first head block. This has the advantage of not having any part of the assembly projecting outside the first head block that may be snagged or interfere with other objects during the operation of the first head block.

In a more preferred embodiment, the extendable members may be arranged such that as the members extend, the respective second ends remain in the same horizontal plane. Further following engagement with the second head block, the second ends may remain in the same horizontal plane and thus any force applied by the extendable members to the second head block through the second ends will be restricted to the horizontal plane only.

In a preferred embodiment, the lateral engagement member may include an actuation means biasing the engagement portions into opposed directions said directions being colinear with the extension axis. In a more preferred embodiment, the actuation means may include two separate actuators, each acting on a respective engagement portion. Alternatively, the actuation means may include a single bi-directional actuator capable of independent actuation on the engagement portions and further may include selective arrangements of the bi-directional actuator to permit co-dependent actuation of the engagement portions.

Thus the actuation means of the lateral engagement member may be capable of independently moving the engagement portions or alternatively moving the engagement portions in a co-dependent manner for instance having the movement of a first engagement portion follow the movement of a second engagement portion.

In a preferred embodiment, operation of the engagement assembly may be subjected to a control system whereby a processor processes an operator's instruction to activate the extendable arms and/or the lateral extension member. Further the control system may include an initiation sequence whereby the assembly automatically moves from a first orientation to a second orientation, said first orientation being in disengagement with the second head block and said second orientation being in engagement with the second head block. One such alternative arrangement for the initiation sequence may include automatically extending the extendable arms until at least one engagement portion contacts the second head block. The control system may then extend the second extendable arm until that respective engagement portion also contacts the second head block and then retracting the lateral engagement member until both engagement portions engage the second head block.

Thus the operation of the control system may free the operator from engagement through an automated sequence. For instance, contact of the extendable arms with the second head block may be through a limit switch adjacent to this second end. Alternatively, said contact may be detected through the use of a load cell in communication with the second end such that on detection of an increase in applied load, the control system acts on said contact to move to the next step within the sequence.

BRIEF DESCRIPTION OF DRAWINGS

It will be convenient to further describe the present invention with respect to the accompanying drawings that illustrate possible arrangements of the invention. Other arrangements of the invention are possible and consequently the particularity of the accompanying drawings is not to be understood as superseding the generality of the preceding description of the invention.

DESCRIPTION OF PREFERRED EMBODIMENT

Figure 1:
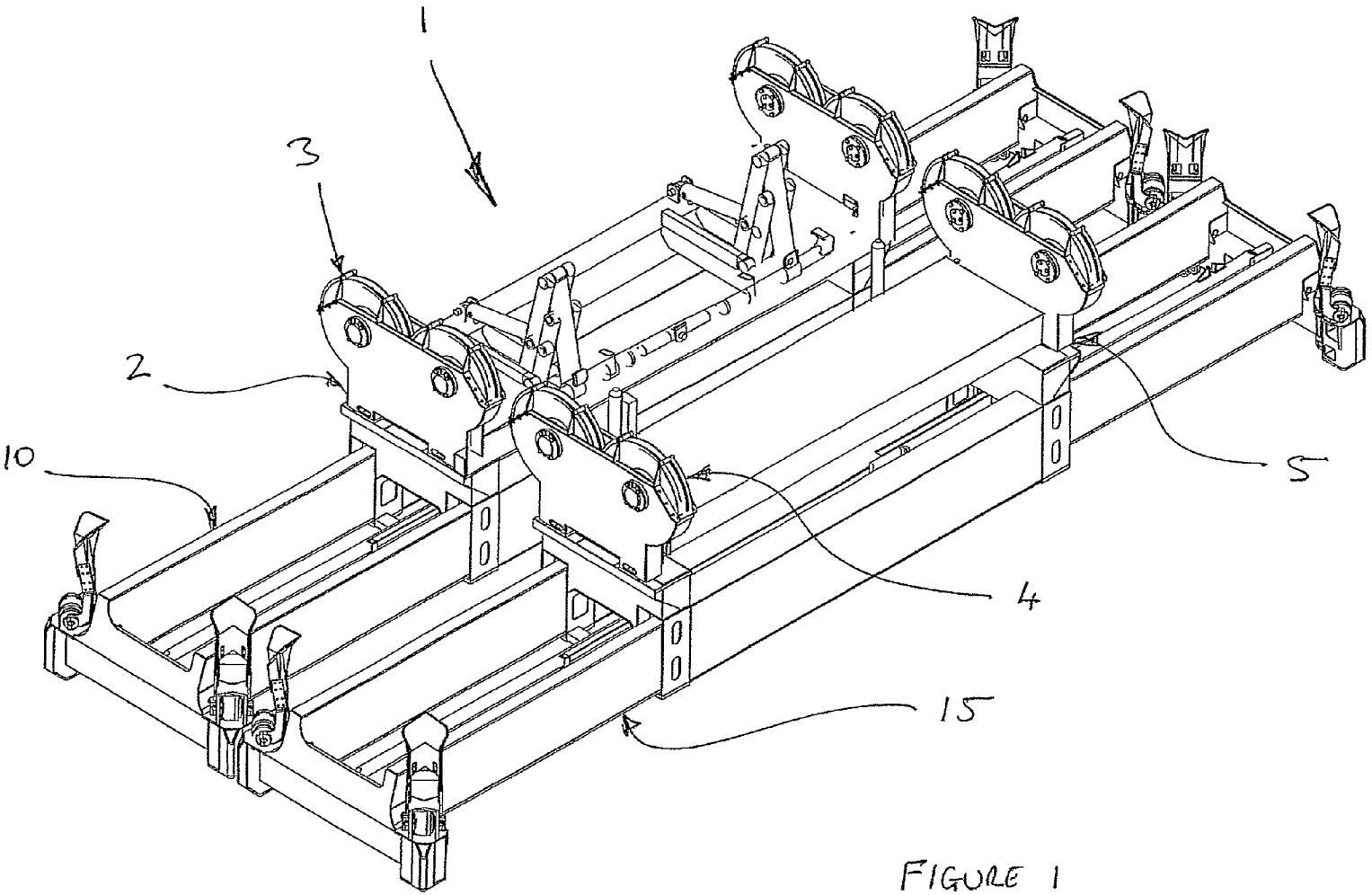
FIG. 1 is an isometric view of a pair of head blocks and spreaders having an engagement assembly according to a first embodiment of the present invention.

FIG. 1 shows a pair of head blocks 2, 5 mounted to two spreaders 10, 15 and placed in proximity in order to act together. Not shown are cables which would engage the head blocks 2, 5 through sheaves 3, 4. Further is shown an engagement assembly 1 mounted to the first head block 2 which is adapted to engage portions on the second head block 5 so that together the head blocks 2, 5 can act with the spreaders 10, 15 to move two containers simultaneously. The nature of the engagement assembly 1 is such that the first head block 2 can engage or disengage from the second head block 5 at any point either at rest or in mid air and avoid the problems of the prior art through being relatively resistant to tolerance when engaging the second head block 5.

Figure 2:
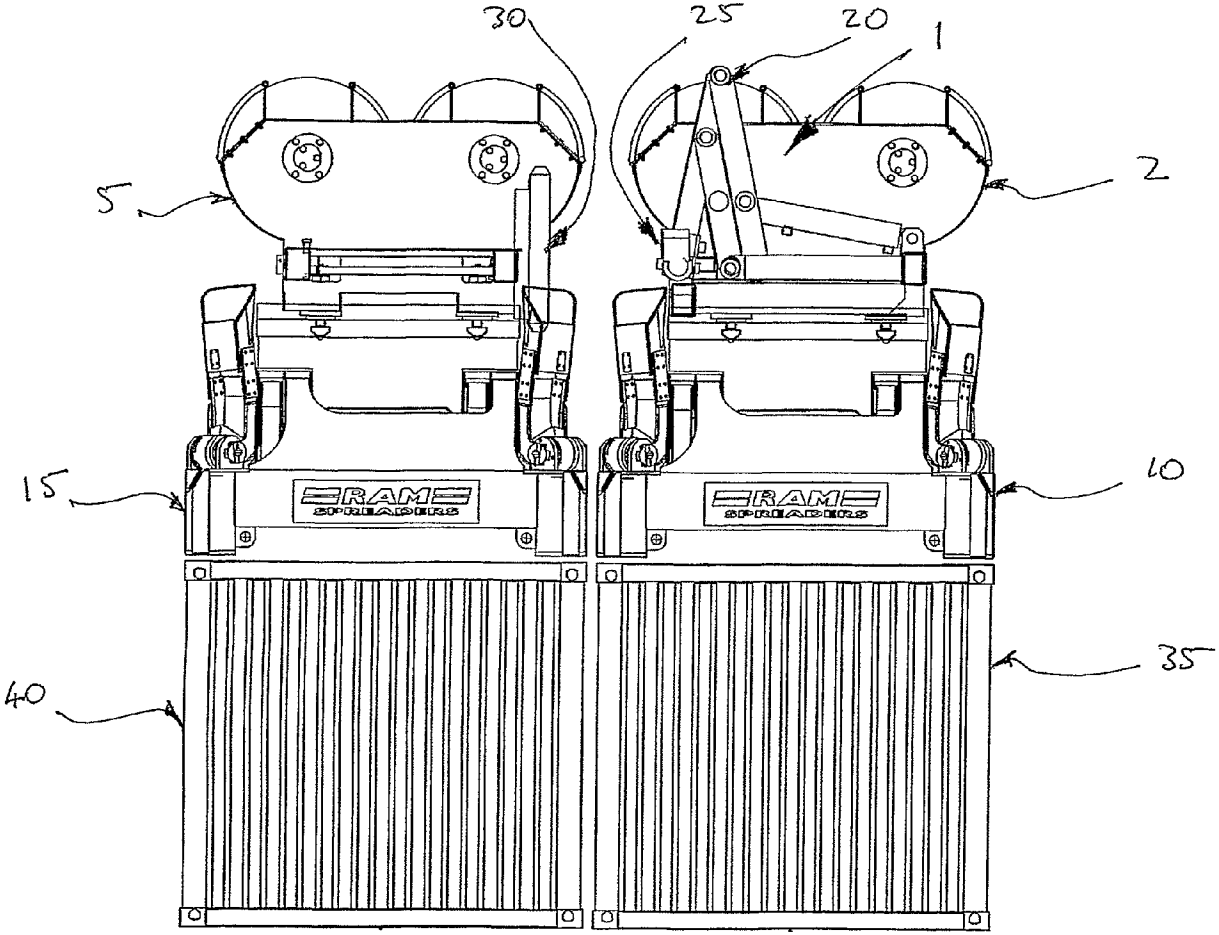
FIG. 2 is a side elevation view of the head blocks of FIG. 1 together with associated spreaders and containers.

FIG. 2 shows a side elevation view of the head blocks 2, 5. Mounted to these spreaders 10, 15 are containers 35, 40. This figure shows the engagement assembly 1 in the disengaged position, that is, the extending arms 20 having an engagement portion 25 at a distal end of the engagement extendable arm 20 has been retracted within the first head block 2.

Further shown in this view is the portion on the second head block 5 to which the engagement assembly 1 will engage the second head block 5. In this embodiment, the engagement bracket 30 is a vertical rod of at least 1 meter length to which the engagement portion 25 can wrap around in order to permit free relative vertical movement of the head blocks 2, 5 but controlling relative movement of the first head block 2 and second head block 5 in the horizontal plane. It will be appreciated however, that the rod can be of any practical length, as would be appreciated by the skilled addressee.

Figure 3:
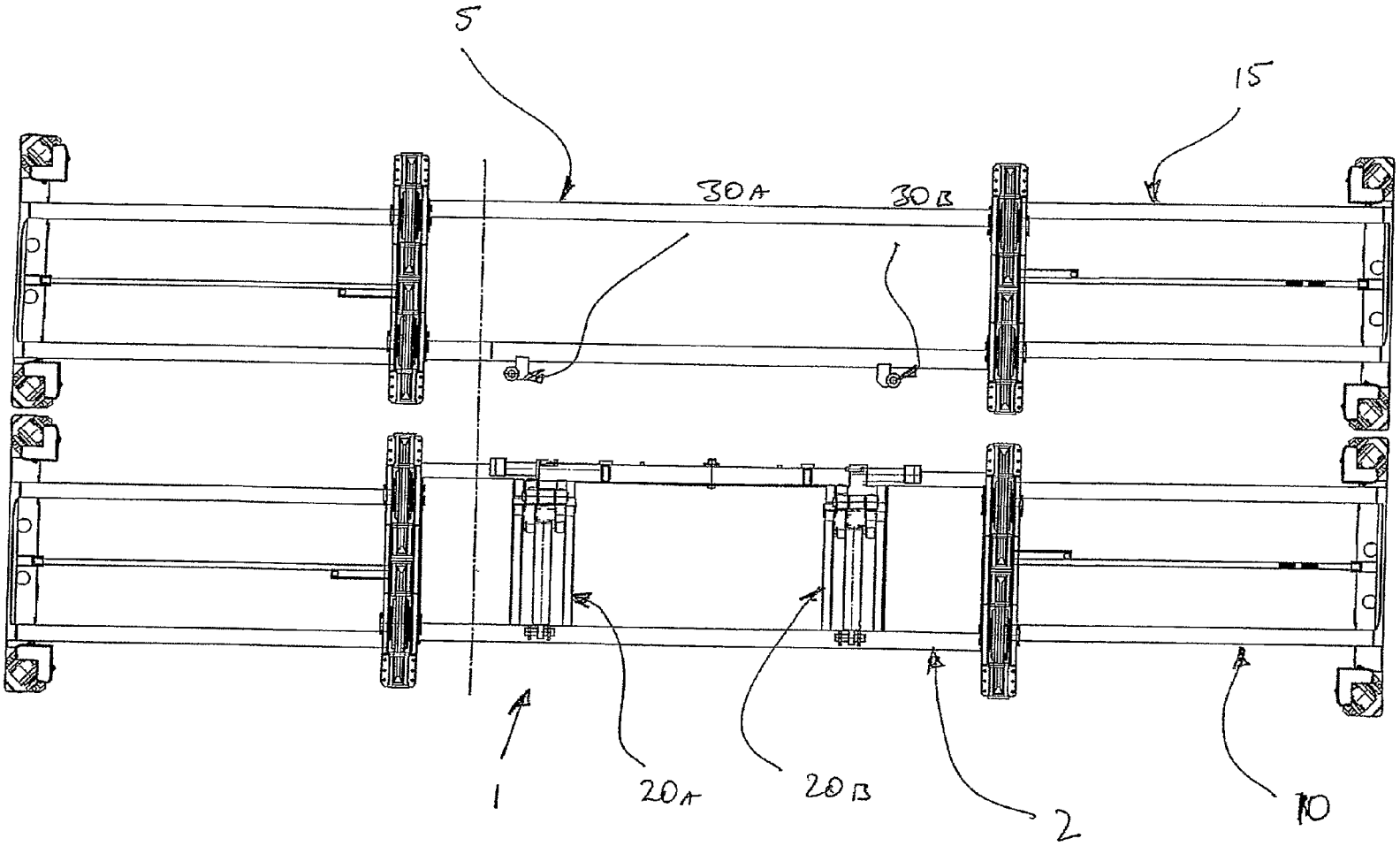
FIG. 3 is a plan view of the head blocks and spreaders according to FIGS. 1 and 2.

FIG. 3 shows a plan view of the head blocks 2, 5 and the engagement assembly 1 according to the present invention. In particular it shows the engagement assembly 1 in the retracted position whereby extendable arms 20A, B are fully retracted within the plan dimensions of the first head block 2. FIG. 3 further shows the engagement brackets 30A, B being rods mounted to the second head block 5 which are engaged by the engagement portions of the engagement assembly 1.

Figure 4:
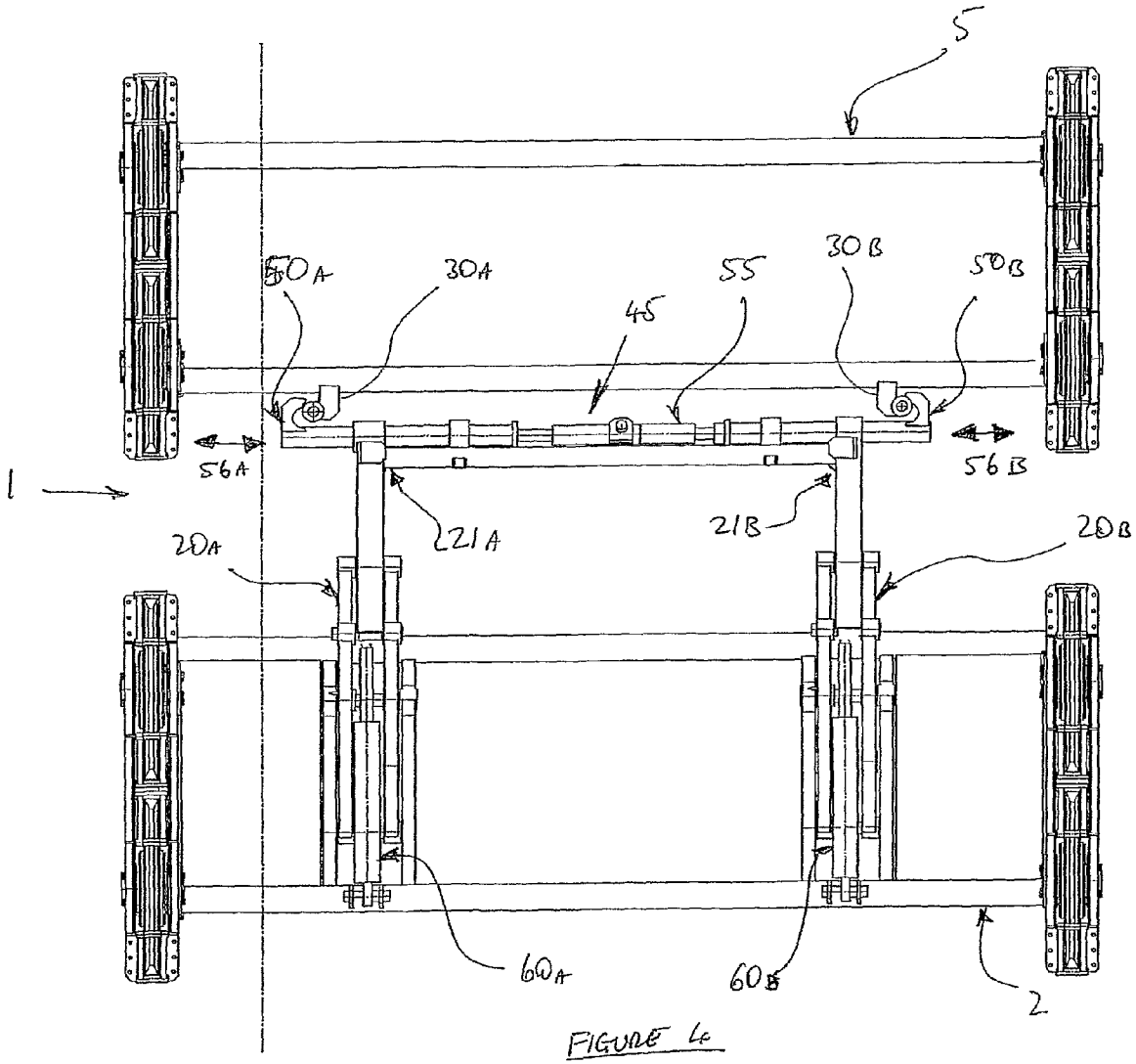
FIG. 4 is a plan view of a pair of head blocks coupled using the engagement assembly according to the first embodiment of the present invention.

FIG. 4 shows a detail plan view of the head blocks 2,5 and in this case where the engagement assembly 1 is in the extended position whereby extendable arms 20A, B have extended the lateral engagement member 45 so as to be proximate to the second head block 5. Further the lateral extension member 45 having engagement portions 50A, B have been retracted so as to engage the engagement brackets 30A, B. The engagement portions 50A, B in this embodiment are hooked shaped which are free to vertically move relative to the engagement brackets 30A,B but prevent unselected relative movement in the horizontal plane of the head blocks 2,5. The view shows the engagement portion 50A, B in actual contact with the rods forming part of the engagement brackets 30A, B. In a normal position the engagement portions 50A, B will not necessarily be in constant contact with the brackets 30A, B but merely proximate to said brackets 30A, B. Of course, any small amount of relative movement between the head blocks 2, 5 will result in a regular if not constant contact with the brackets. Thus sliding engagement between the engagement portions and engagement brackets is notional and in fact in this embodiment, it is preferred that contact is made only to restrict relative movement in the horizontal plane and no contact be made that might hinder vertical relative movement, though in practice the clearance is likely to be only a few millimeters, and so ensuring regular contact.

In this embodiment, the lateral engagement member 45 comprises a bi-directional actuator 55 which can selectively move the engagement portions 50A, B linearly 56A, B by extending and retracting said portions. The lateral engagement member 45 is mounted to distal ends of 21A, B of the extendable arms 20A, B such that on extension of the extendable arms 20A, B the lateral engagement member 45 is brought into proximity with the second head block 5. Thus the engagement assembly 1 substantially comprises extendable arms 20A, B and a means to engage the second head block which is located at the extendable portions of the extendable arms 20A, B so as to engage the second head block 5.

In this embodiment the extendable arms 20A, B extended using single actuators 60A, B which may be operated by an operator (not shown) in order to extend the linkage arrangement of the extendable arms 20A, B. In this embodiment it will be noted that the extension and the engagement functions of the engagement assembly 1 can be achieved by three actuators only being extension actuator 60A,B and the lateral engagement actuator 55.

Figure 5:
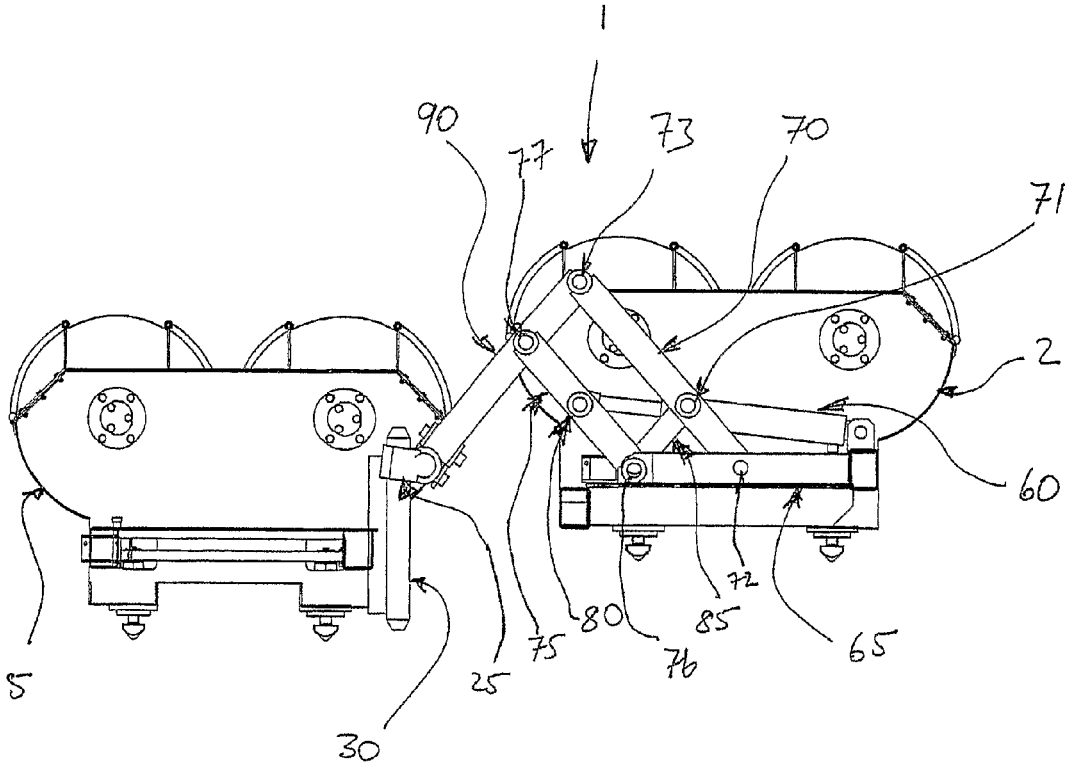
FIG. 5 is a side elevation view of the head blocks and engagement assembly according to FIG. 4.

FIG. 5 shows a detail view of the engagement assembly 1 and in particular an embodiment of the present invention using a linkage arrangement in order to model the extendable arm. In this embodiment the extendable arm comprises a linkage of two parallel members 70, 75 both of which are rotatably connected to a base member 65. Further the upper parallel member 70 is also in sliding engagement with the base member 65 such that on extension of the extendable arm, upper parallel member 70 rotates about a pivot point 71 with rotational and translational movement at the base end 72 and at the upper linkage end 73. Rotation about the intermediate pivot point 71 is ensured by linkage member 85 so as to pivotally connect the pivot point 71 to the base end 76 of the lower parallel member 75.

The parallel members 70, 75 are connected to reach member 90 so that connection point 73, 77 of the parallel members 70 and 75 being in spaced relation and consequently, the parallel members 70, 75, pivot member 85 and reach member 90 forming a parallelogram. The reach member 90 terminates at the lateral engagement member which the engagement portion 25 are mounted. As previously described the extendable member is actuated through a hydraulic ram 60, in this embodiment, which is also mounted at one end to the head block 2 and at a distal end at an intermediate pivot point 80 of the lower parallel member 75. Consequently on activation of the ram 60, the extendable member extends from the first head block 2 to the second head block 5. Because of the parallelogram arrangement of the linkage, the engagement portion 25 is restricted to movement within the horizontal plane.

Figure 6:
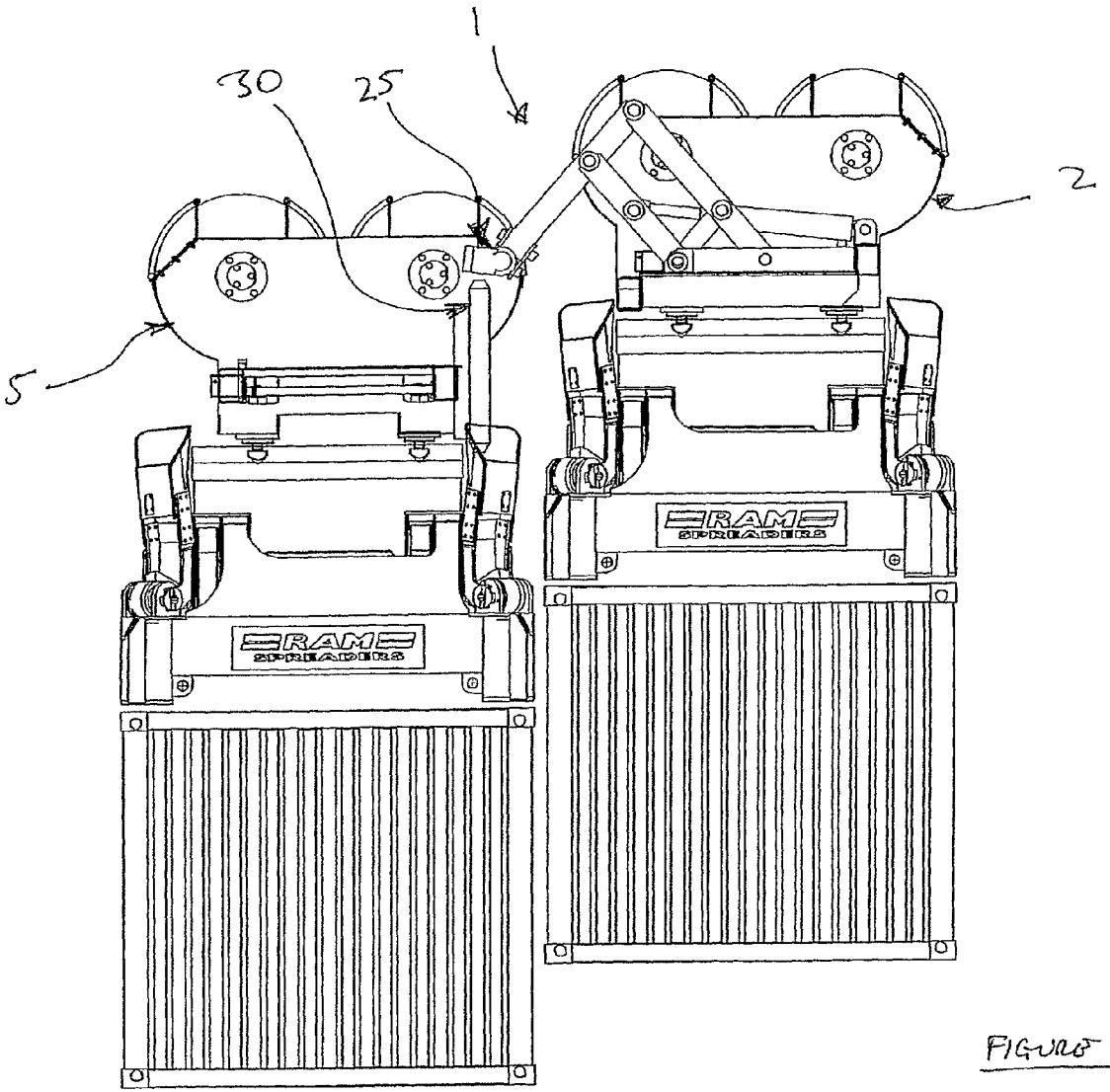
FIG. 6 is an elevation view of two head blocks each connected to a spreader and a container having an engagement assembly according to the first embodiment of the present invention.

As discussed, engagement and disengagement can be effected by the lateral engagement member 45 extending the engagement portions 25 and then retracting them to couple with the engagement brackets 30. An alternative disengagement method is that shown imminently in FIG. 5 whereby hoists (not shown) selectively raise the first head block 2 or lower the second head block 5. Because the engagement assembly 1 is not affected by relative vertical movement, the engagement portion 25 slides up the engagement bracket 30 and as shown in FIG. 6 eventually disengages the first head block 2 from the second head block 5. Thus in addition to using the lateral engagement member 45 to disengage the head blocks 2, 5, relative vertical movement of the head blocks 2, 5 through adjusting the hoists may also selectively disengage the head blocks 2, 5.

Figure 7:
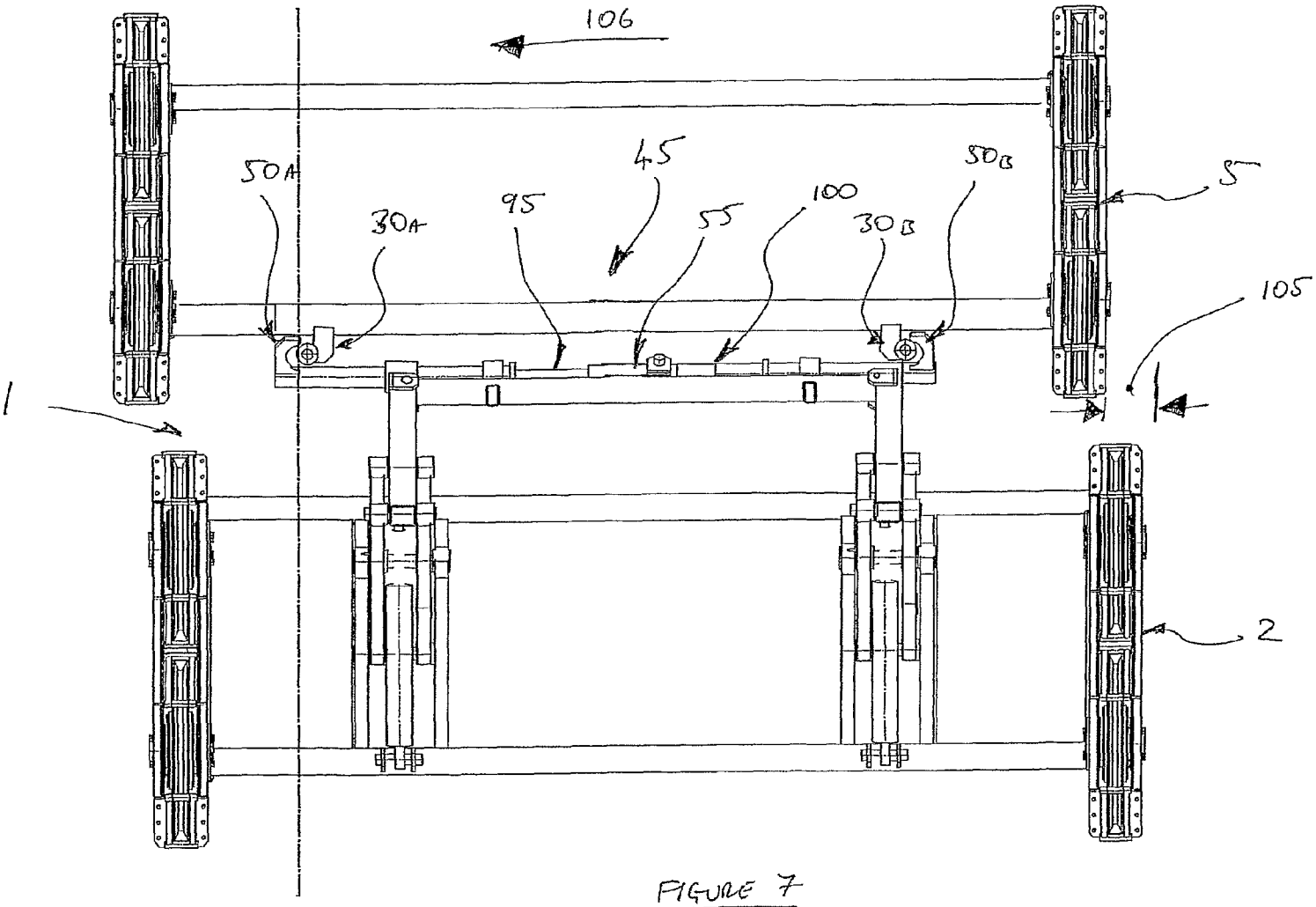
FIG. 7 is a plan view of the head blocks and engagement assembly of FIG. 4.

FIG. 7 shows a further embodiment of the present invention whereby the engagement assembly 1 can effect an offset 105 of the head blocks 2, 5. To achieve this the head blocks 2, 5 may be held in spaced relation to each other with the lateral engagement member 45 selectively adjusting the bi-directional actuator 55. In this case one direction of the bi-directional actuator 55 extends 95 the engagement portion 50A. Simultaneously the second direction 100 retracts by the same amount and so shifting the second engagement portion 50B in the same direction as the extension of the first engagement portion 50A. This has the consequence of maintaining engagement with the engagement bracket 30A, B. Thus the offset 105 is achieved by the second engagement portion 50B applying a force to the second engagement bracket 30B to shift the second head block 5 in the desired direction 106. Because the head blocks 2, 5 are in engagement, the offset 105 does not affect the parallel arrangement of the head blocks 2, 5 and so effecting a pure offset 105 by merely manipulating the lateral engagement member 45.

Figure 8:
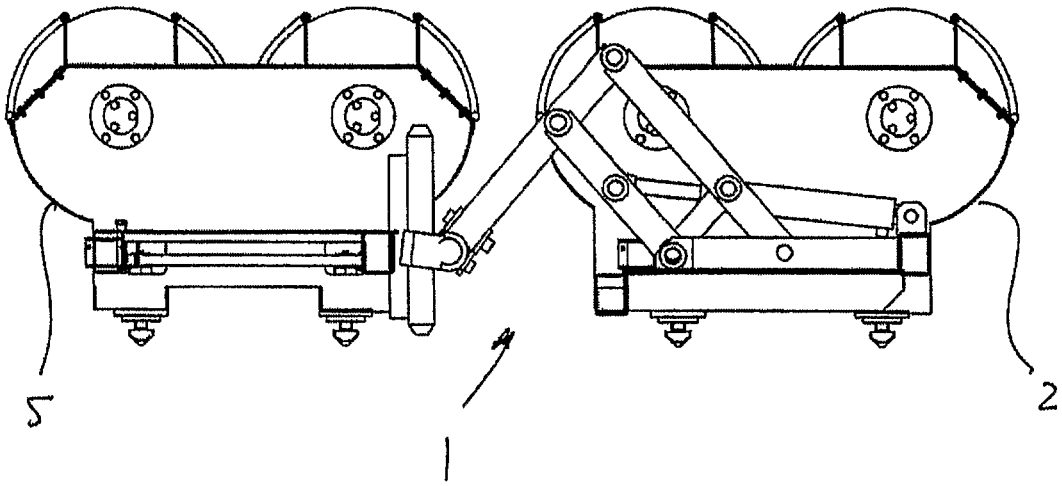
FIG. 8 is a side elevation view of the head blocks and engagement assembly of FIG. 5.
Figure 9:
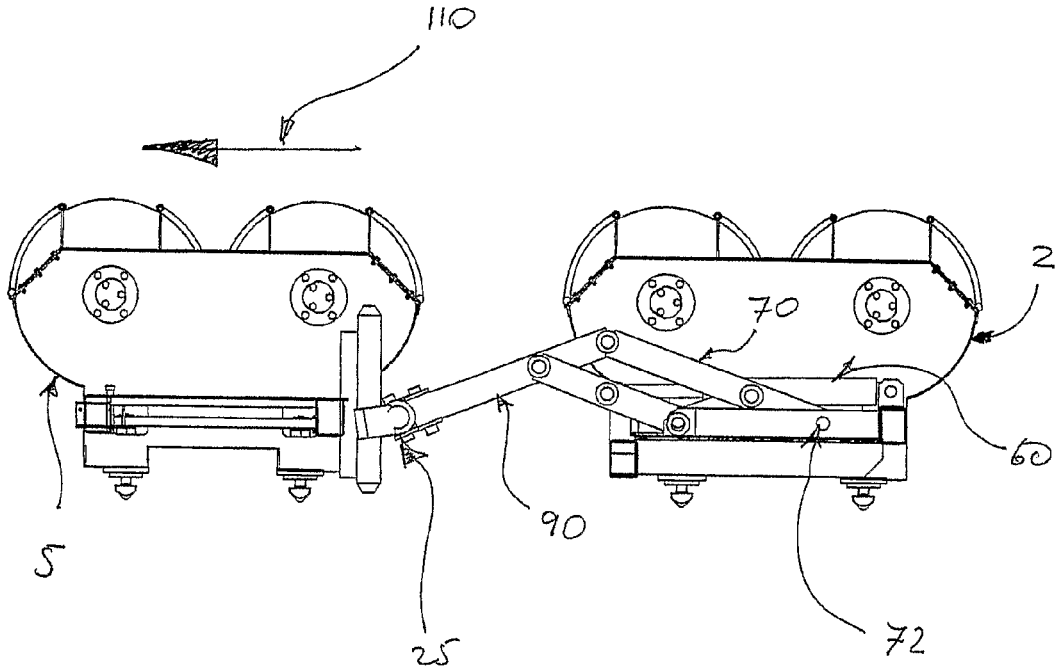
FIG. 9 is a side elevation view of the head blocks and engagement assembly of FIG. 8.

FIGS. 8 and 9 show a further embodiment of the present invention whereby the engagement assembly 1 achieves a relative separation 110, again by manipulating control of the actuators 60. In this case the head blocks 2, 5 are shifted 110 from a proximate position as shown in FIG. 8 to a distal position as shown in FIG. 9 by extending the ram of the actuator 60 and so extending the extendable arm and consequently pushing the second head block 5 further from the first head block 2. Consequently the parallelogram formed by the linkages of the extendable arm is deformed, and so, maintains the engagement portion 25 within the same horizontal plane despite the deformation of the parallelogram. This is achieved by a shift in the pivot point 72 of the upper parallel member 70 with that movement compensated by a shift in the reach member 90 leading to the increase in separation 110.

Figure 10:
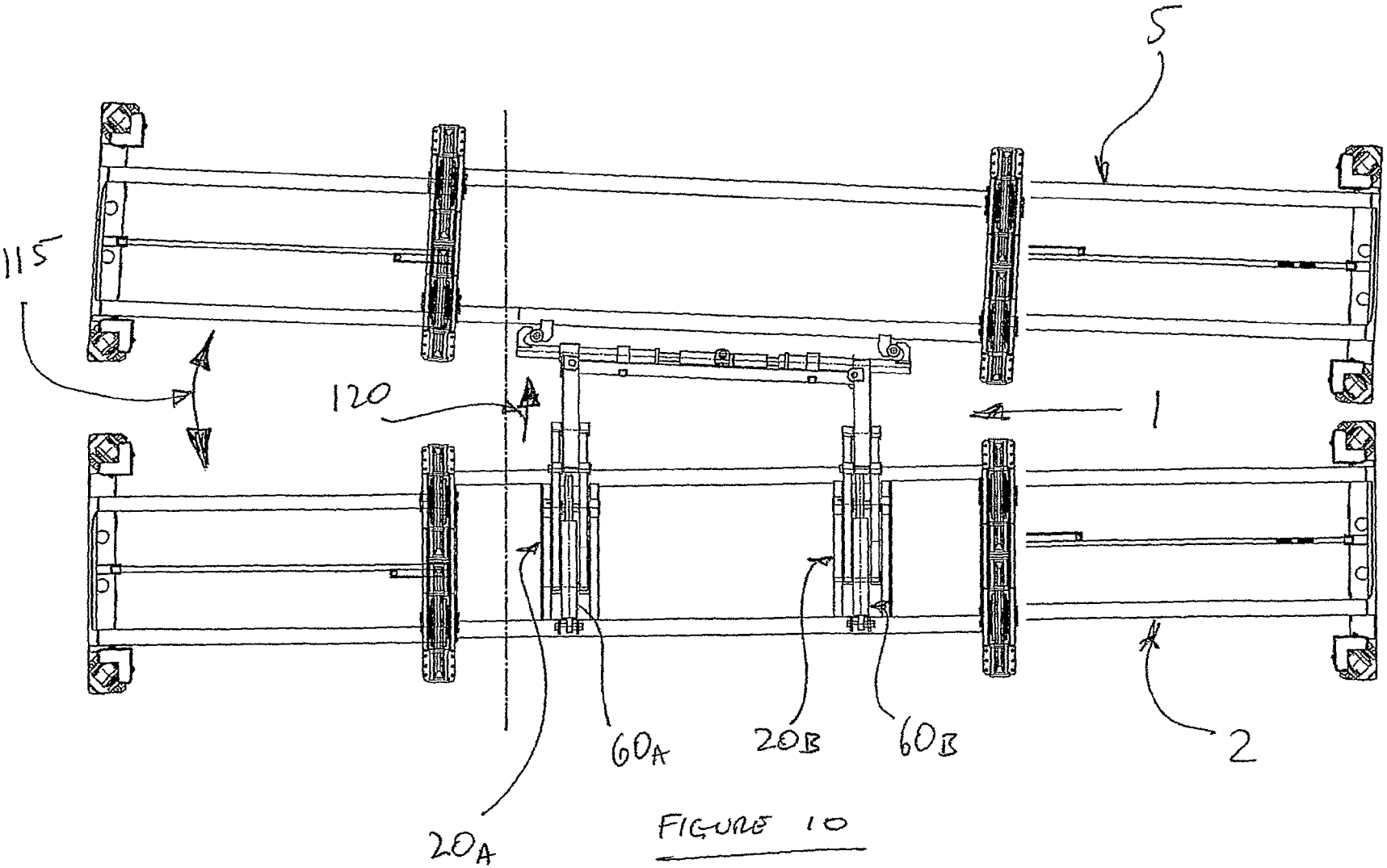
FIG. 10 is a plan view of the head blocks and spreaders of FIG. 3, in a skew position.

FIG. 10 shows a further embodiment of the present invention whereby the engagement assembly 1 can effect a skewed 115 orientation between the first head block 2 and the second head block 5.

By extending the first ram 60A of the first extendable arm 20A, the extendable arm 20A can move from a position similar to that of FIG. 8 to that shown in FIG. 9. At the same time, the actuator 60B is locked so as to maintain the second extendable arm 20B in a position similar to that shown in FIG. 8. Consequently as the first extendable arm 20A extends 120 the desired distance, the result is a relative rotation 115 of the head blocks 2, 5 providing a skewed effect and so aiding in the placement of individual containers whilst the head blocks 2,5 are in engagement.

Figures 11A, 11B:
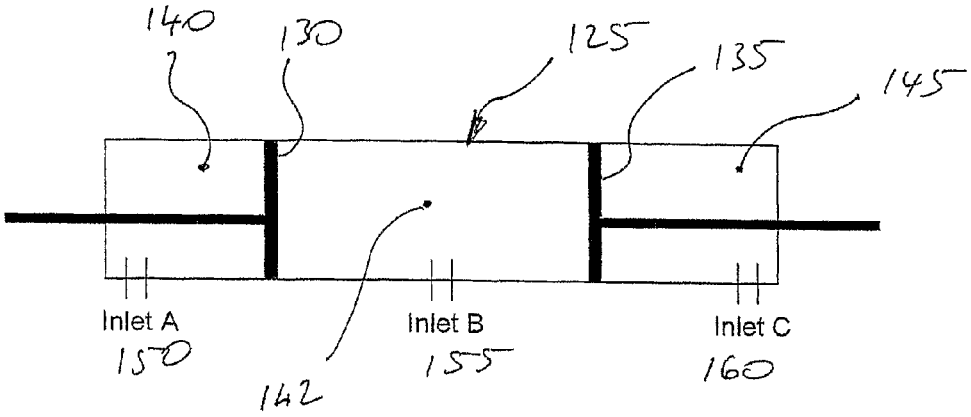
FIG. 11A is a schematic view of an actuator associated with the lateral engagement member according to a further embodiment of the present invention.
FIG. 11B is a lookup table mapping the function of the actuator of FIG. 11A.

FIG. 11A shows a schematic view of the bi-directional actuator 55 in one embodiment of the present invention. Here a first ram 130 in communication with the first engagement portion 50A is directly influenced by hydraulic oil entering a first chamber 140 and an intermediate chamber 142. The oil entering the first chamber 140 enters through Inlet A 150 with oil entering the intermediate chamber 142 through Inlet B 155. A second ram 135 in communication with the second engagement portion 50B is influenced by a second chamber 145 and the intermediate chamber 142 whereby hydraulic oil entering the second chamber 145 enters through Inlet C 160.

Possible permutations of oil entering or exiting the inlets and so entering the first, second and intermediate chambers 140, 142, 145 are shown in FIG. 11B. In the lookup table of FIG. 11B, "1" indicates oil entering the chamber, "−1" indicates oil leaving the chamber and "0" indicates the chamber being closed and therefore incompressible.

The first permutation 170 has hydraulic oil entering the first chamber 140 through the Inlet A 150, oil exiting the intermediate chamber 142 and oil entering the second chamber 145 and so indicating a "1" for Inlet A, "−1" for Inlet B, "1" for Inlet C. As indicated in the schematic drawing relating to the first permutation 170, this will cause the rams 130 and 135 to be directed inwards and thus retract the first and second engagement portions 50A, B. This action is required for the lateral engagement member 45 engaging the engagement brackets 30A, B.

The second permutation 175 indicates for Inlets A, B and C a "1", "0" and "4". The consequence of this arrangement leads to the rams 130, 135 to be directed to the right which if the head blocks 2, 5 were in engagement would lead to an offset similar to that shown in FIG. 7, but in the opposite direction.

The third permutation 180 indicates the inlets being "−1", "1", "−1" and so the first and second chambers 140, 145 having oil exiting the chamber with oil entering the intermediate chamber 142. This would lead to the rams extending outwards and so extending the engagement portions 50A, B which would lead to a selective disengagement of the head blocks 2,5.

The fourth permutation 185 has for Inlets A, B and C "1", "−1", "0" which would have the second chamber 145 fixed in volume, oil exiting the intermediate chamber 142 but oil entering the first chamber 140. Thus the first ramp 130 would move to the right whilst the second ramp 135 would stay in a fixed position. This might be, for instance, part of an automatic sequence whereby the second engagement portion 50B may already be in engagement with the engagement bracket 30B and so bringing the first engagement portion into contact with the engagement bracket 30A.

The fifth permutation 190 shows the reverse of the fourth permutation 185 and so may be an adjustment in order to re-engage the second head block.

Figure 12:
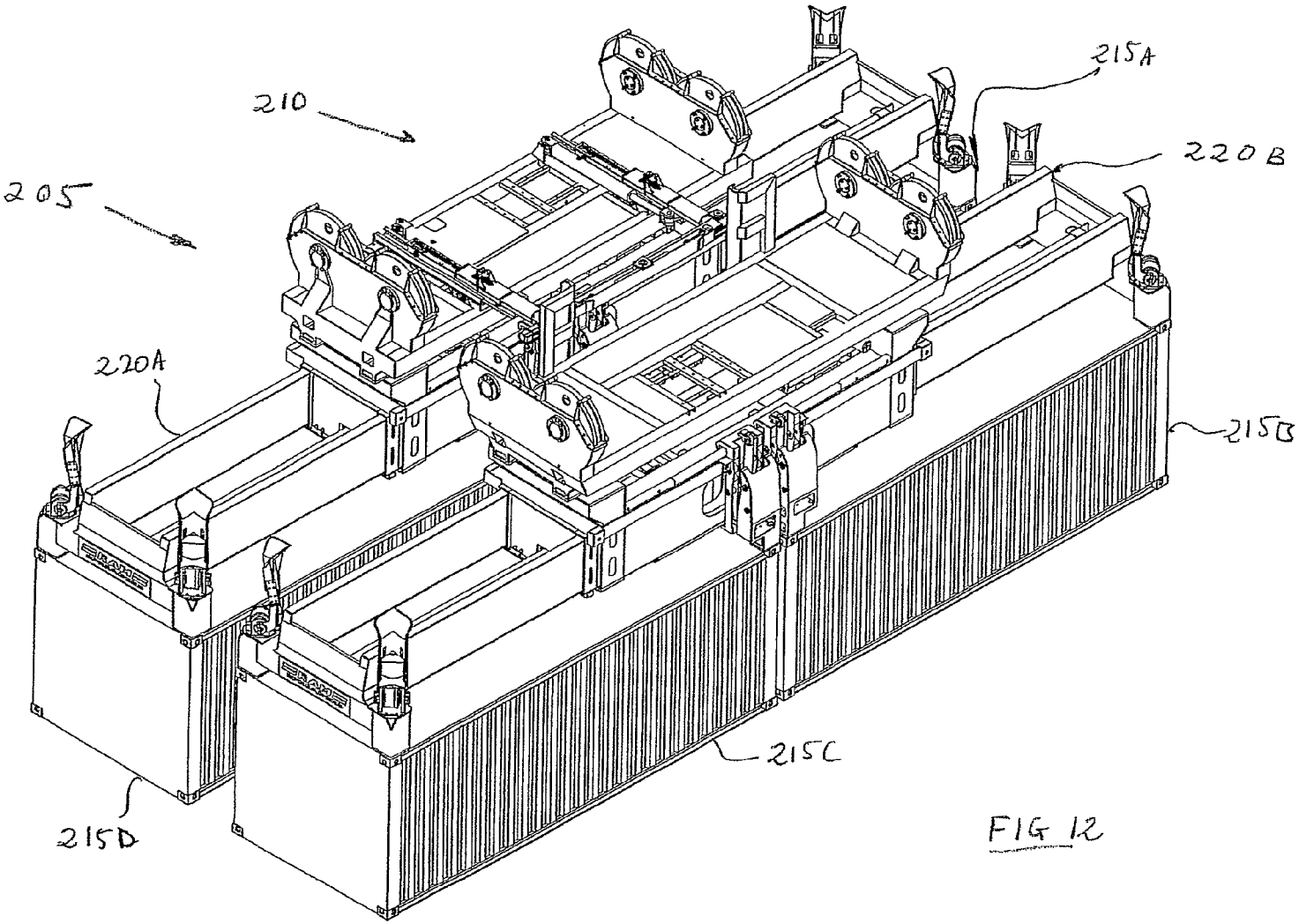
FIG. 12 is an isometric view of the engagement assembly according to a second embodiment of the present invention.

FIG. 12 shows an overview of a second embodiment of the container engagement assembly 205 comprising a pair of head blocks 210 mounted to two spreaders 220A, B. In this embodiment the spreaders 220A, B are twin container spreaders and thus each spreader 220A, B is mounted to a pair of containers 215A to D. Accordingly, the container engagement assembly 205 is mounted to four containers 215A to D and thus carrying the full capacity of this particular arrangement.

Figure 13:
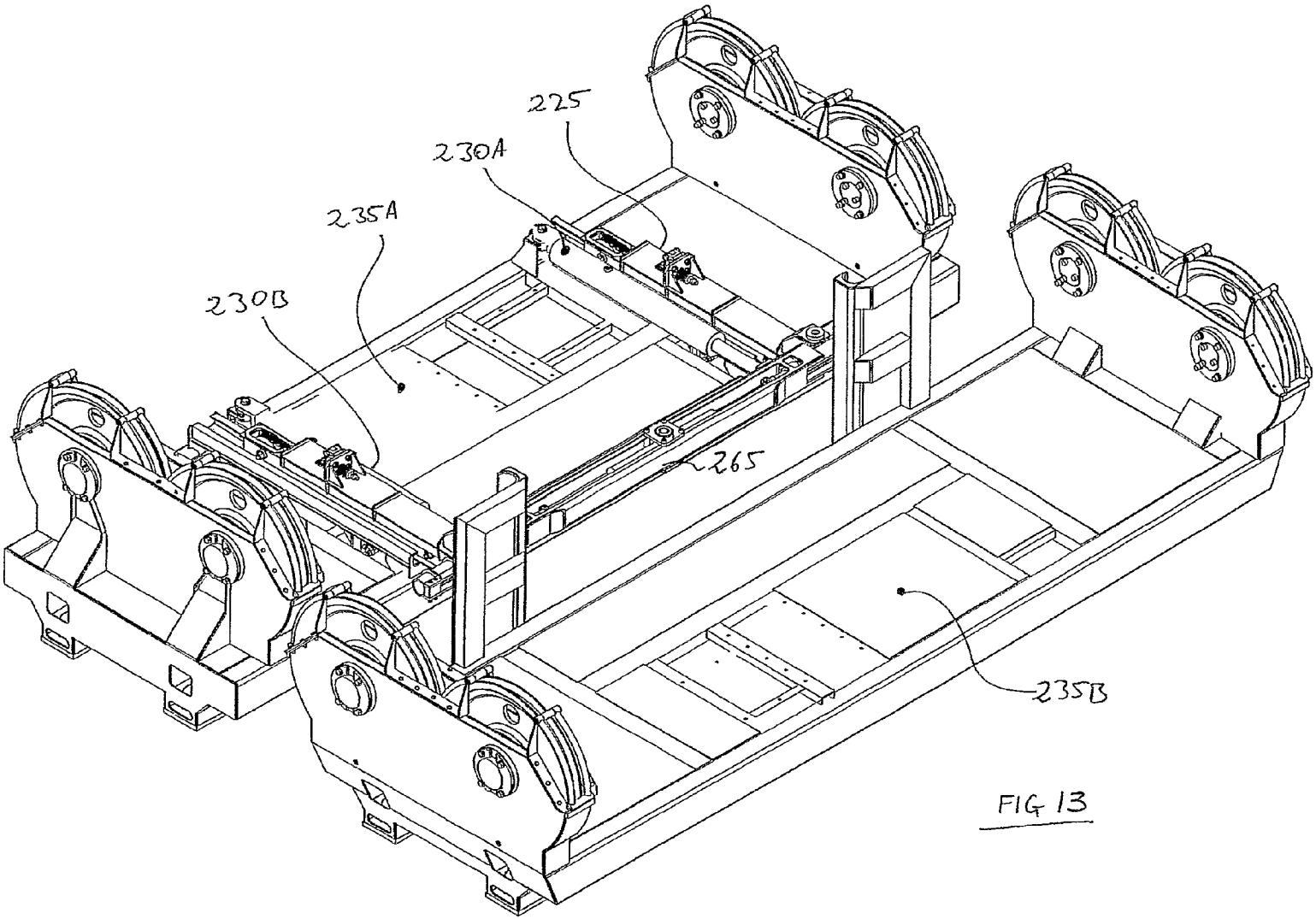
FIG. 13 is an isometric view of the engagement assembly of FIG. 12 mounted to a pair of head blocks.

FIG. 13 shows the head blocks 235A, B of the container engagement assembly 205 whereby the head blocks 235A, B are engaged through an engagement assembly 225 according to one embodiment of the present invention. In this case the engagement assembly 225 comprises two extendable members 230A, B which are mounted to a first head block 235A and extending outwards towards a second head block 235B. At extreme ends of the extendable members 230A, B is a lateral engagement member 265 for engaging the second head block 235B so as to both connect the head blocks 235A, B and control the relative position of the head blocks 235A, B as will be discussed.

Figure 14A:
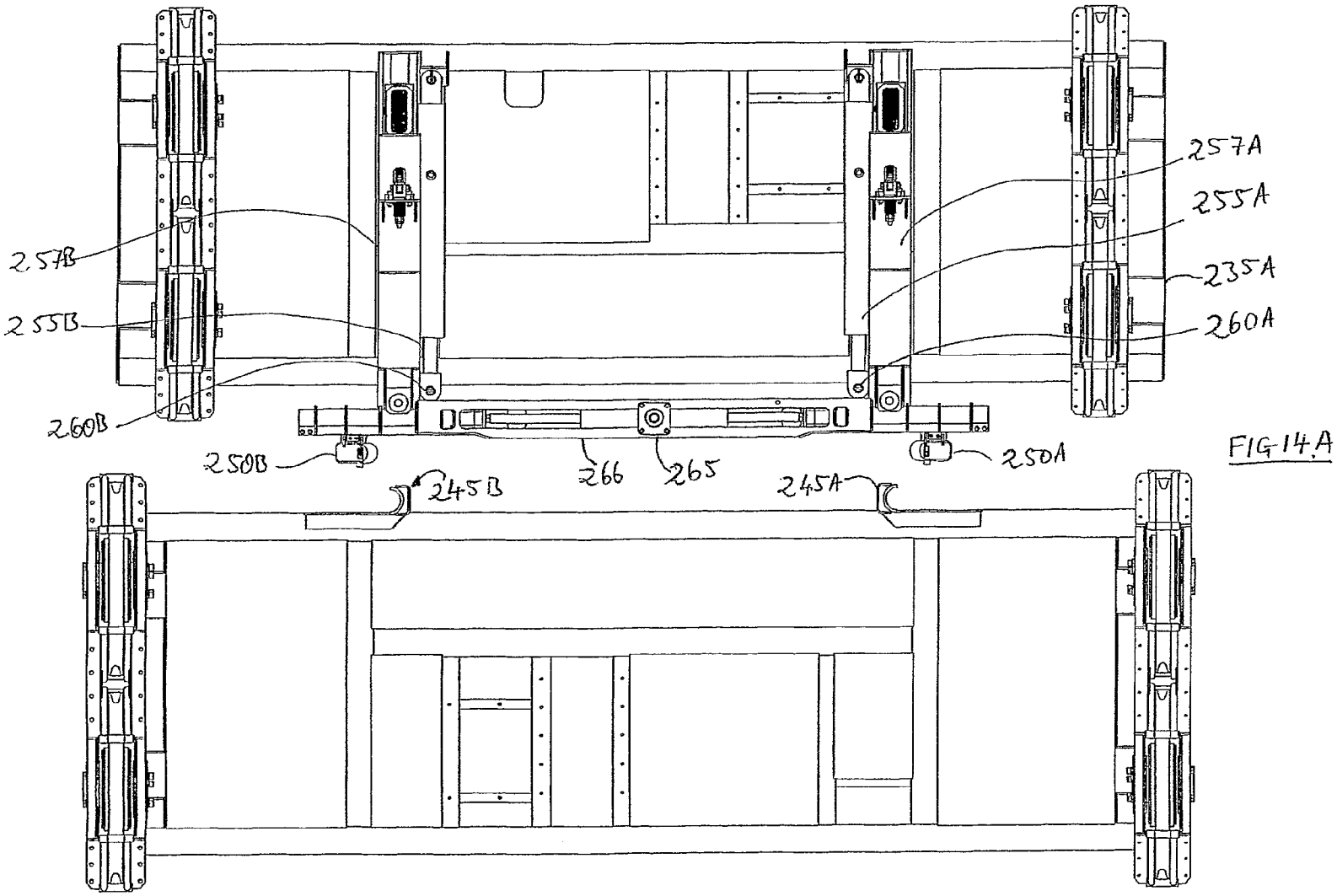
FIGS. 14A to 14C are plan views of the engagement assembly of FIG. 12.

FIG. 14A shows a plan view of the engagement assembly 225. The assembly 225 comprises parallel extension members 257A, B which are extendable from the first head block 235A to which the assembly 225 is mounted. The extension is achieved by respective hydraulic rams 255A, B mounted to a portion of the extension members 257A, B. Mounted at the extreme ends of both extension members 257A, B is an engagement member 265 which is positioned, in a normal orientation, at right angles to the extension member 257A, B. The engagement member 265, is mounted to the extension member 257A,B with rotational joints such that the engagement member may be rotated within the horizontal plane subject to the relative extension of the two extension members 257A,B. The engagement member 265 further includes a bi-directional hydraulic ram 266 which is arranged to extend and retract engagement lugs 250A,B which are positioned at extreme ends of the engagement assembly 265. It should be noted that the engagement lugs 250A,B are offset from the longitudinal axis of the engagement assembly 265, said offset being on a side of the engagement assembly 265 opposed to that of the first head block 235A. In this embodiment, the actual lugs 250A,B are directed along an axis parallel to, but not co-linear with, the longitudinal axis of the engagement assembly 265 with the direction of said lugs arranged so as to be facing each other and thus directed inwards rather than directed outwards. In light of this arrangement, an embodiment having the lugs co-linear with the engagement assembly 265 is also possible, as is an arrangement whereby the lugs are directed outwards.

The engagement assembly 225 further includes engagement brackets 245A,B which are mounted to a second head block 235B. Each of said brackets 245A,B are hooked shaped, in cross section, with the concave portion directed outwards so as to receive the engagement lugs 250A,B both in position and shape. Said engagement brackets 245A,B further are shaped such that the concave portion of the hooked shape forms a channel along which the engagement lugs 250A,B may slide without hindering said movement. It follows that in order to prevent hindrance of the sliding action said channel is directed along a vertical axis such that when said lugs 250A,B are engaged with said brackets 245A,B that, so long as the relative position of the lugs is maintained, said head blocks may freely move relative to each other along a vertical axis through sliding of said lugs along said channel.

Figure 14B:
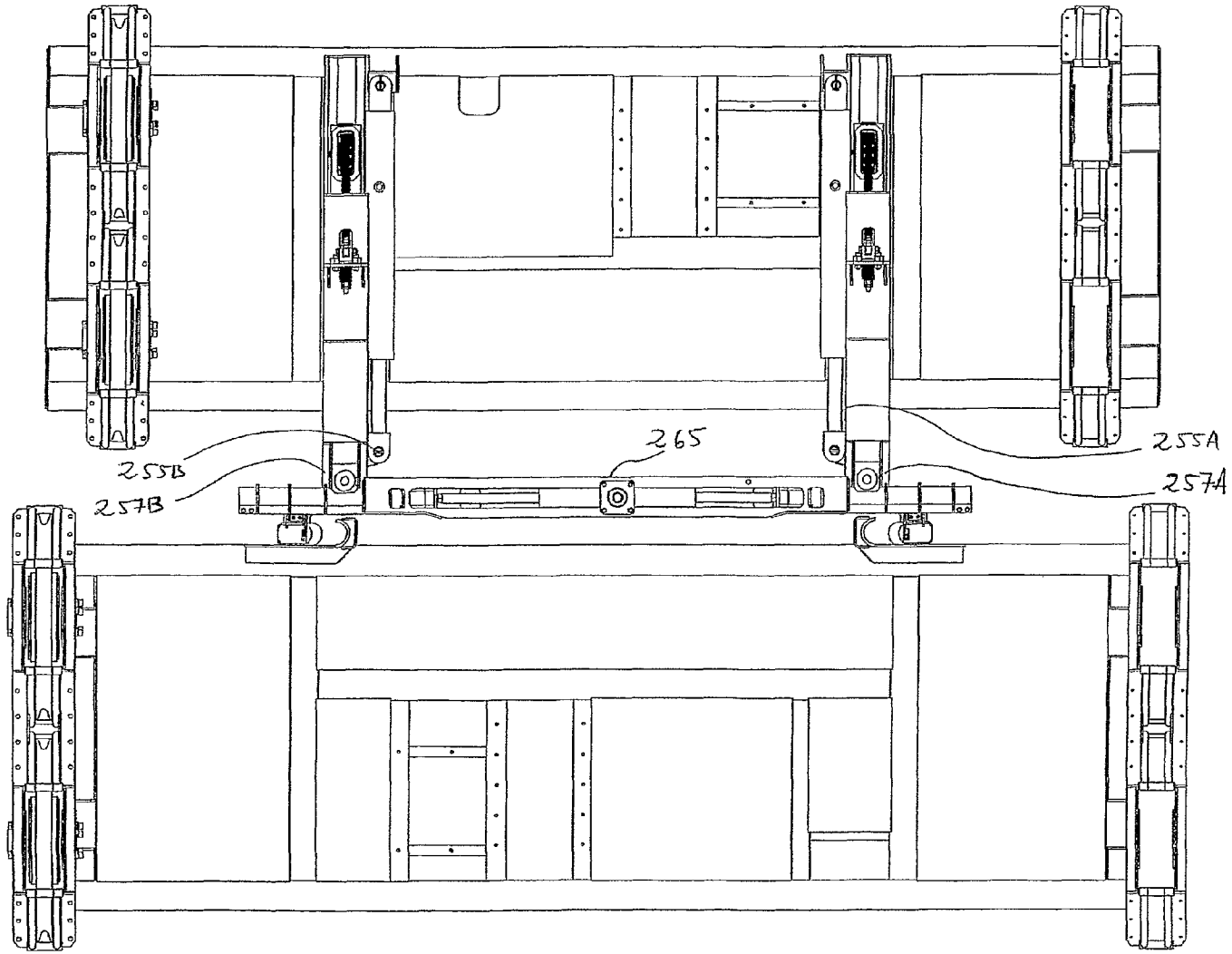
Figure 14C:
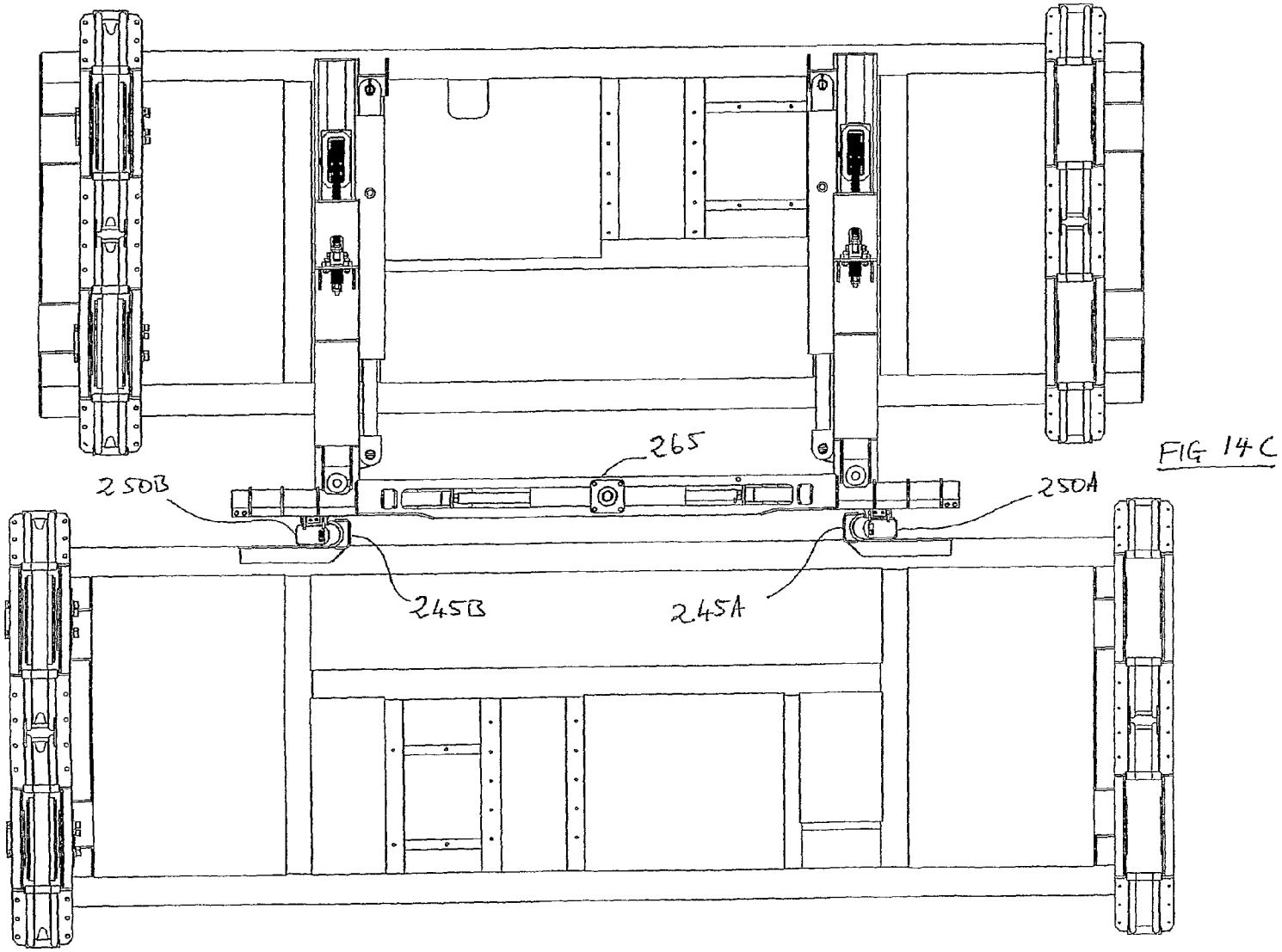

FIGS. 14A to 14C show sequential steps for the engagement assembly to engage the brackets 245A,B and so connect the two adjacent head blocks 235A,B. Accordingly FIG. 14A shows the engagement assembly only partially extended and thus said head blocks are yet to be engaged. It should be noted that, in this view, the bi-directional ram 266 of the engagement member is such that the engagement lugs 250A,B are fully extended.

FIG. 14B shows a further sequential step in the engagement process whereby the engagement members 257A,B have fully extended so as to bring the engagement member 265 into proximity with the second head block 235B. It will be noted that the lugs 250A,B are proximate with the engagement brackets 245A,B but are yet to be retracted by the bi-directional ram so as to fully engage said brackets. As with FIG. 14, whilst the engagement member 265 is proximate to the second head block 235B, because the lugs 250A,B have not engaged the brackets 245A,B, the two head blocks are yet to be in connection.

FIG. 14C shows the actual engagement of the first head block 235A to the second head block 235B. Here the engagement member 265 is still proximate to the second head block 235B and, further, the bi-directional ram 266 has retracted the lugs so as to be in engagement with the brackets 245A,B. In this engagement position the head blocks 235A,B are in fixed relation within the horizontal plane through the engagement of the lugs and the brackets, but as mentioned previously are free to move in the vertical axis through sliding of said lugs within the channel formed by said brackets.

Once engaged, the engagement assembly 225 is capable of performing a number of actions leading to the change of relative positions of the two head blocks 235A,B. Whilst the engagement assembly 225 cannot control the change in relative position along a vertical axis it can, however, adjust the position within certain limits within the horizontal plane. This includes lateral adjustments such as separating the head blocks or drawing the head blocks together so as to bring the containers in close proximity or even into contact. Further, the engagement assembly can form an offset, that is, shift the relative position of the head block 235A,B along parallel axes. Further still, the engagement assembly can cause a skew, that is, a relative rotation of the head blocks 235A,B within the horizontal plane.

Figure 15A:
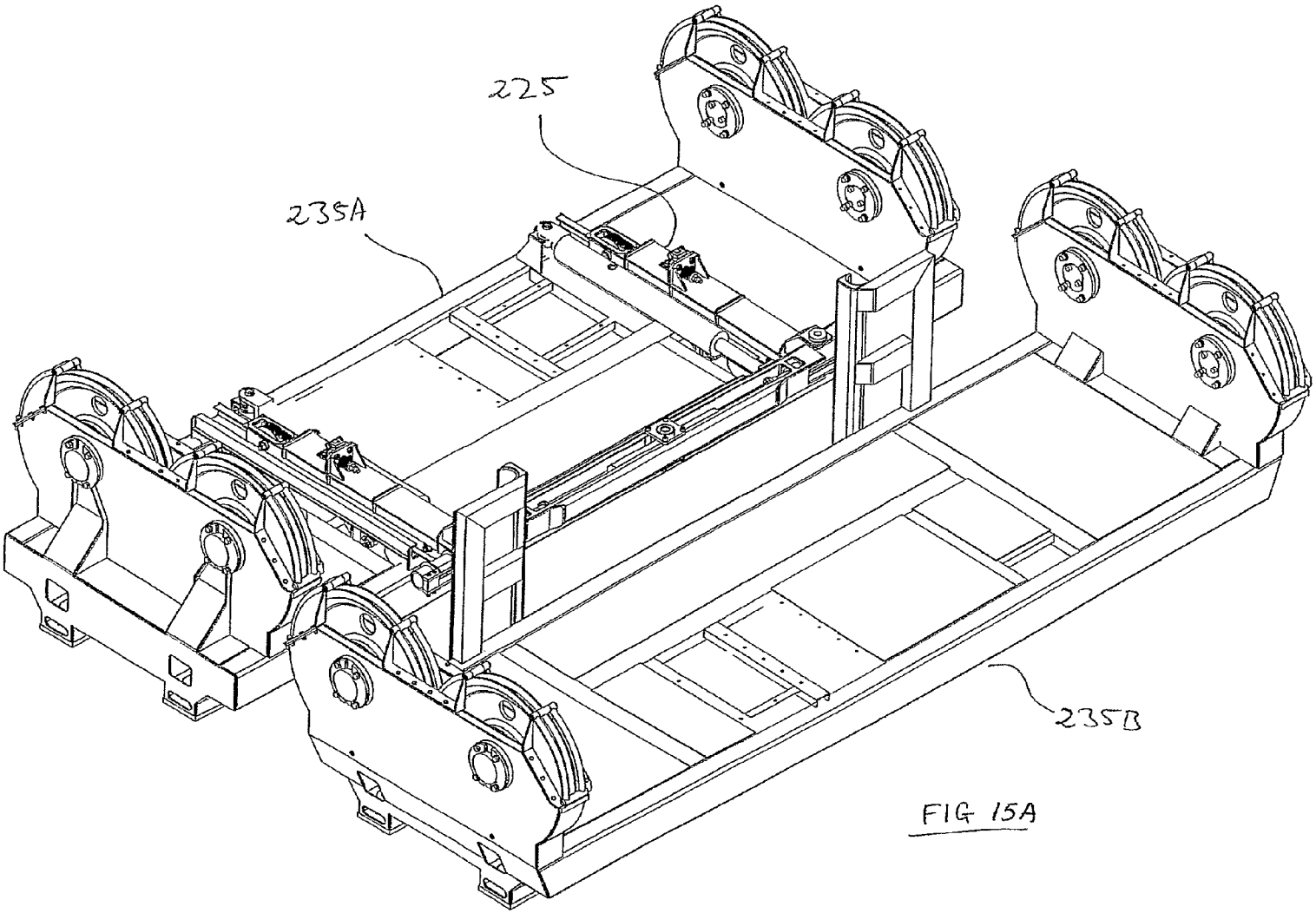
FIGS. 15A and 15B are isometric views of the engagement assembly of FIG. 12 separating two engaged head blocks.
Figure 15B:
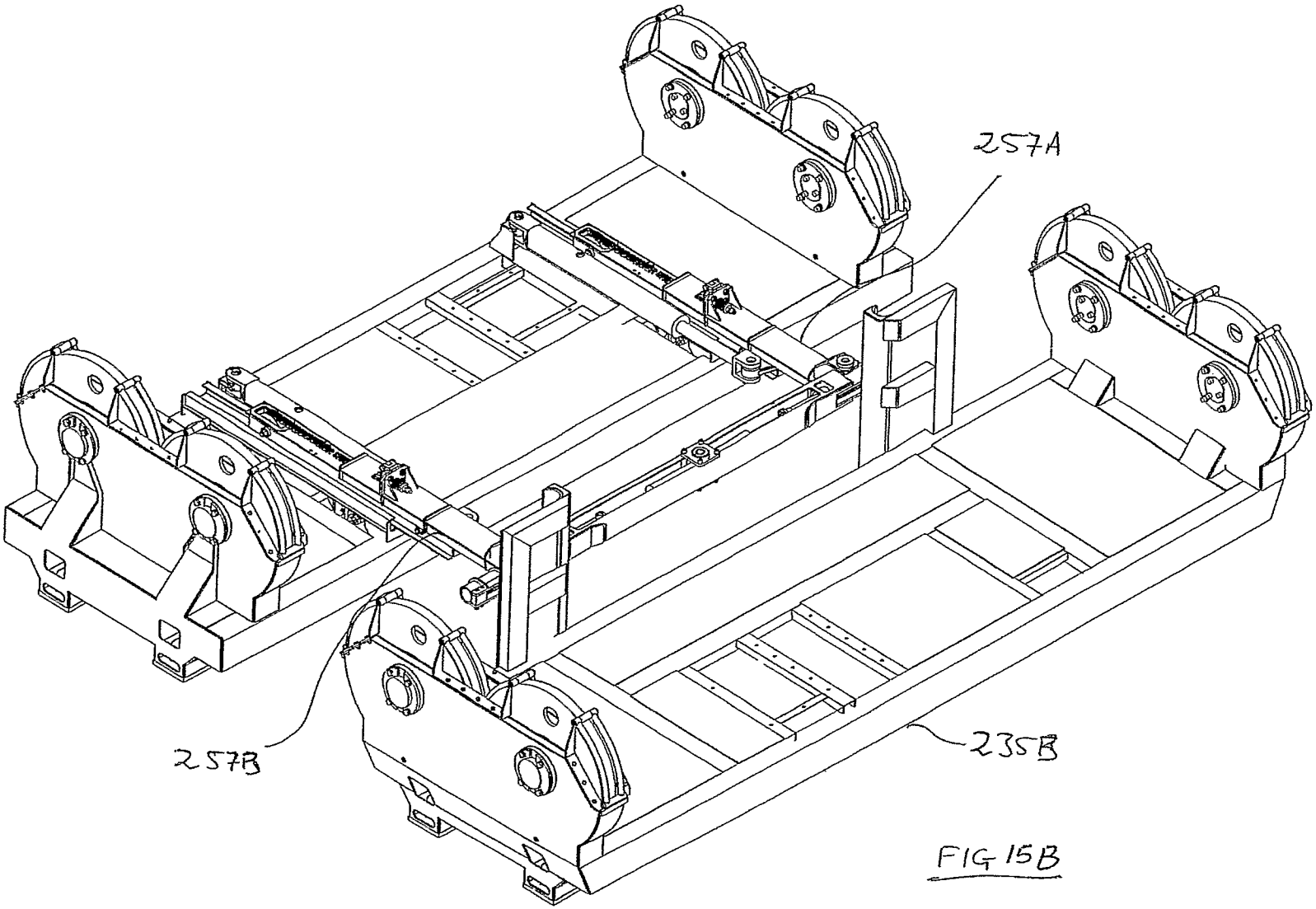

FIGS. 15A and 15B show progressive views of the separation function of the engagement assembly 225. As shown in FIG. 15A, the head blocks are proximate to each other, though not in contact, and thus the engagement assembly is only partially extended. As shown in FIG. 15B, as the extension members 257A,B further extend, the head blocks 235A,B are further separated so as to reach a maximum stroke.

Figures 16A, 16B:
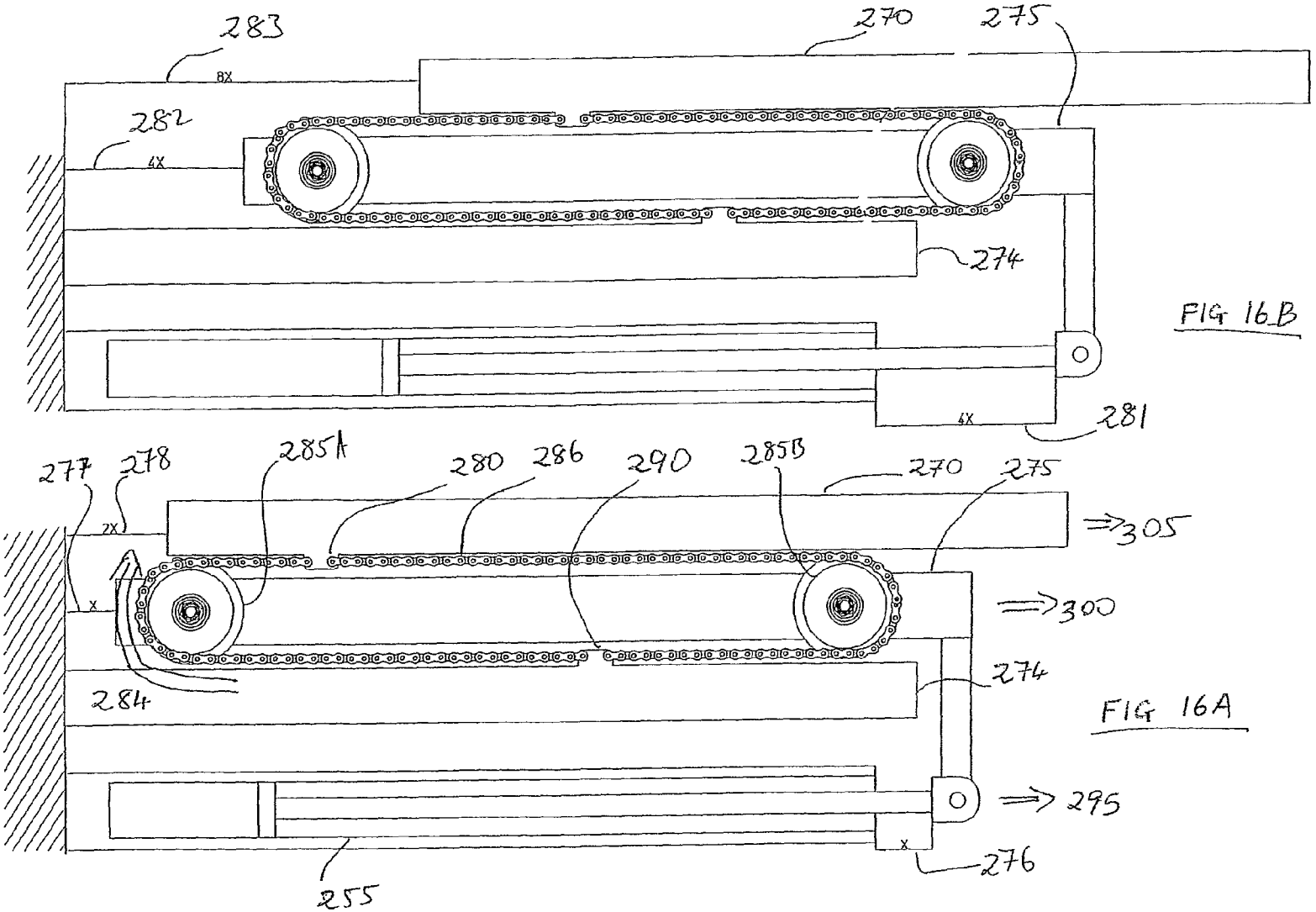
FIGS. 16A and 16B are elevation views of a chain and sprocket arrangement according to the second embodiment of the present invention.

In order to reach the full extension there is a limitation of the extension arms 257A,B as to the maximum extension they can provide. It follows that in a simple construction, the stroke of the ram 255 will limit the length for which the extension arm can extend. FIGS. 16A and 16B show a further embodiment whereby the hydraulic ram 255 is mounted to a first sub-member 275 of the extension member. A second sub-element 270 forms part of the extension member, with a chain and sprocket arrangement 280, 285A, B, 286, 290 separating the two sub-members 270, 275. The arrangement comprises a fixed arm 274 to which the chain 286 is mounted 290. The first sub-member includes sprockets 285A, B at opposed ends about which the chain travels. The chain 286 is further mounted 280 to the second sub-member 275. In this embodiment as the hydraulic ram 255 extends 295, there is a consequent extension 300 of the sub-member 275. Driving the first sub-member 275 a distance X rotates the chain 286. As the chain travels about the sub-member 275, this causes a subsequent compound movement 2× of the second sub-member 270. As shown in FIG. 16B, the compound effect is further demonstrated whereby the first sub-member 275 undergoes movement 4× which is leads to the movement 8× of the second sub-member 270.

Figure 17A:
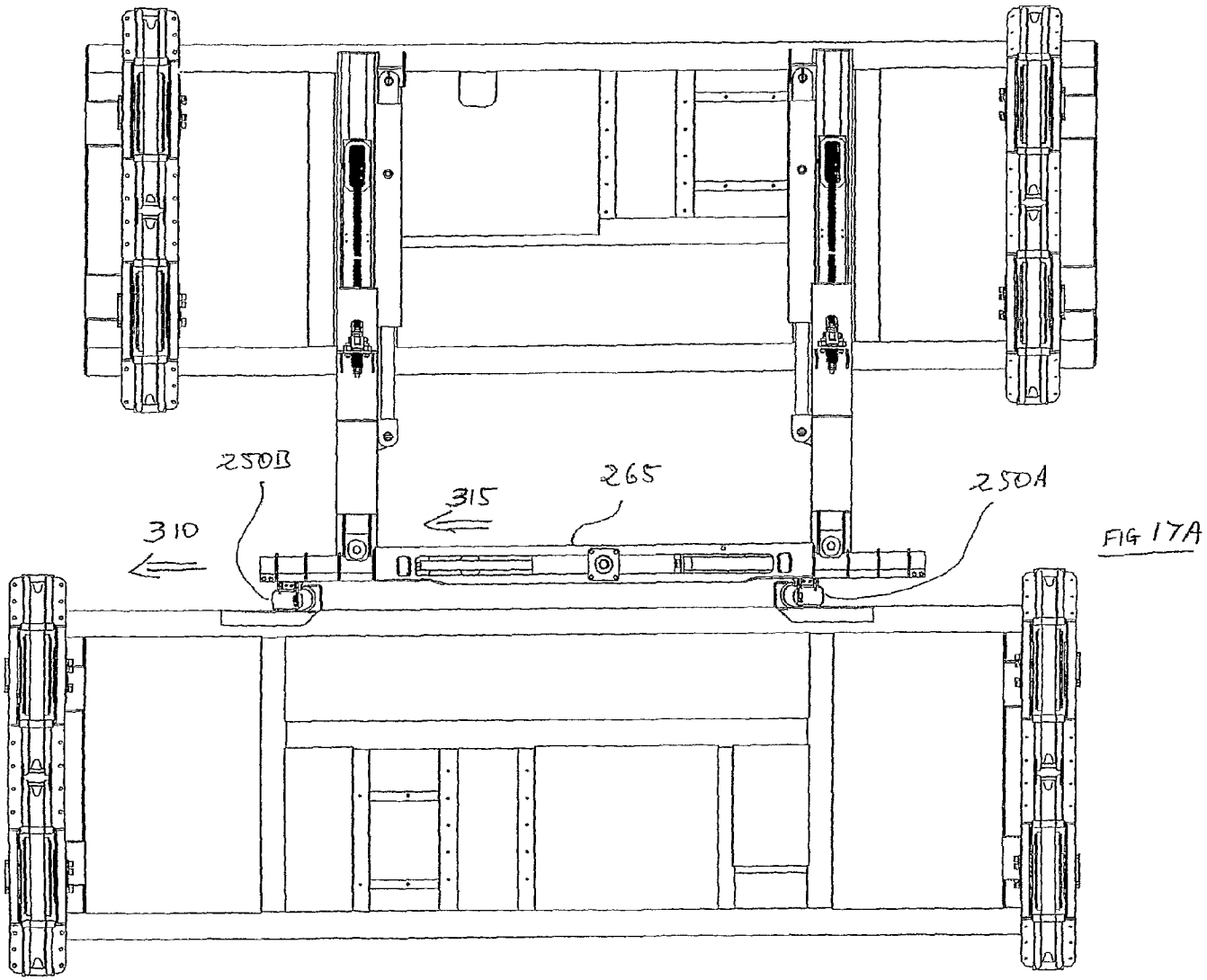
FIGS. 17A and 17B are plan views of the engagement assembly of FIG. 12 offsetting to two adjacent head blocks.
Figure 17B:
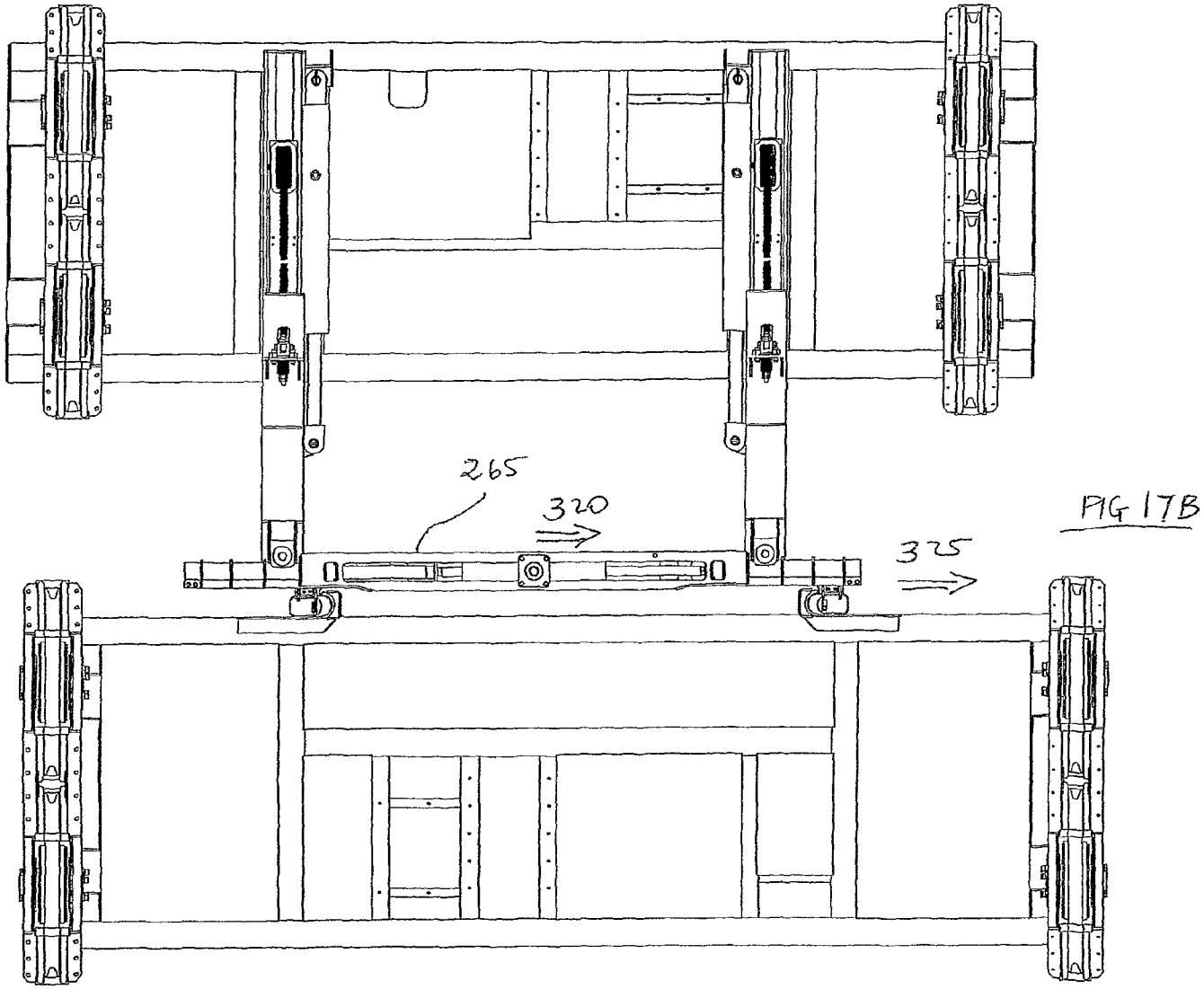

FIGS. 17A and 17B show the offset function of the engagement assembly 225, achieved by the bi-directional ram 266 within the engagement member 265. As stated previously, engagement of the lugs with the engagement brackets is achieved by mutually retracting the lugs so as to engage the brackets. After engagement, and as shown in FIG. 17A, if a first lug 250A is further retracted by the bi-directional ram 266 but a second lug 250B is extended, this has the effect of moving the lugs 250A,B in the same direction. Whilst in engagement with the engagement brackets 245A,B, this applies a force so as to shift 310, the second head block 235B in the same direction. As shown in FIG. 17B, to offset the head blocks in the other direction, the direction of the lugs is reversed so that the second lug 250B is retracted above the first lug 250A extended. Thus by controlling the bi-directional rams 266, this has the effect of offsetting the position of the head blocks 235A, B relative to each other along parallel axes.

Figure 18:
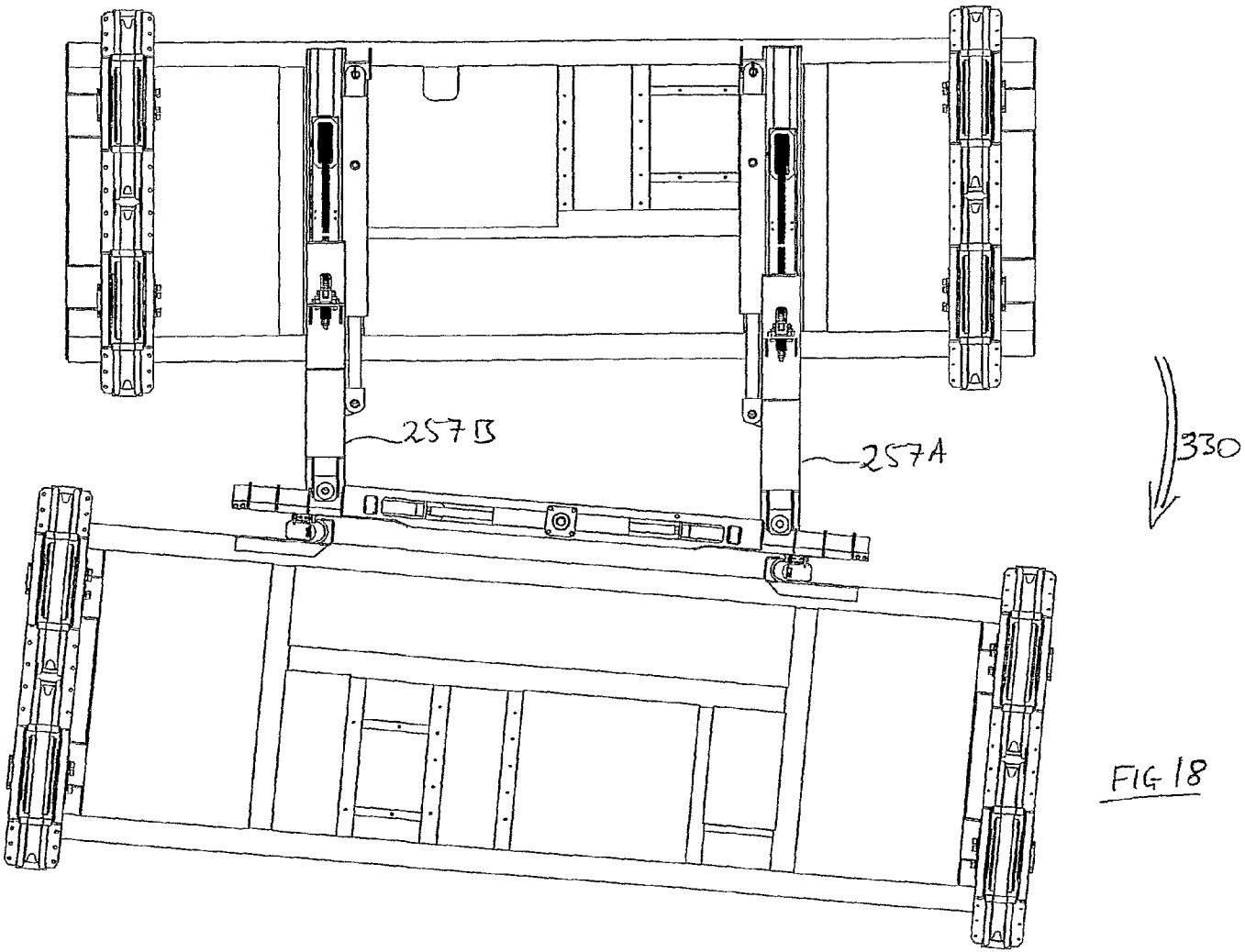
FIG. 18 is a plan view of the engagement assembly of FIG. 12 skewing two adjacent head blocks.
Figure 19A:
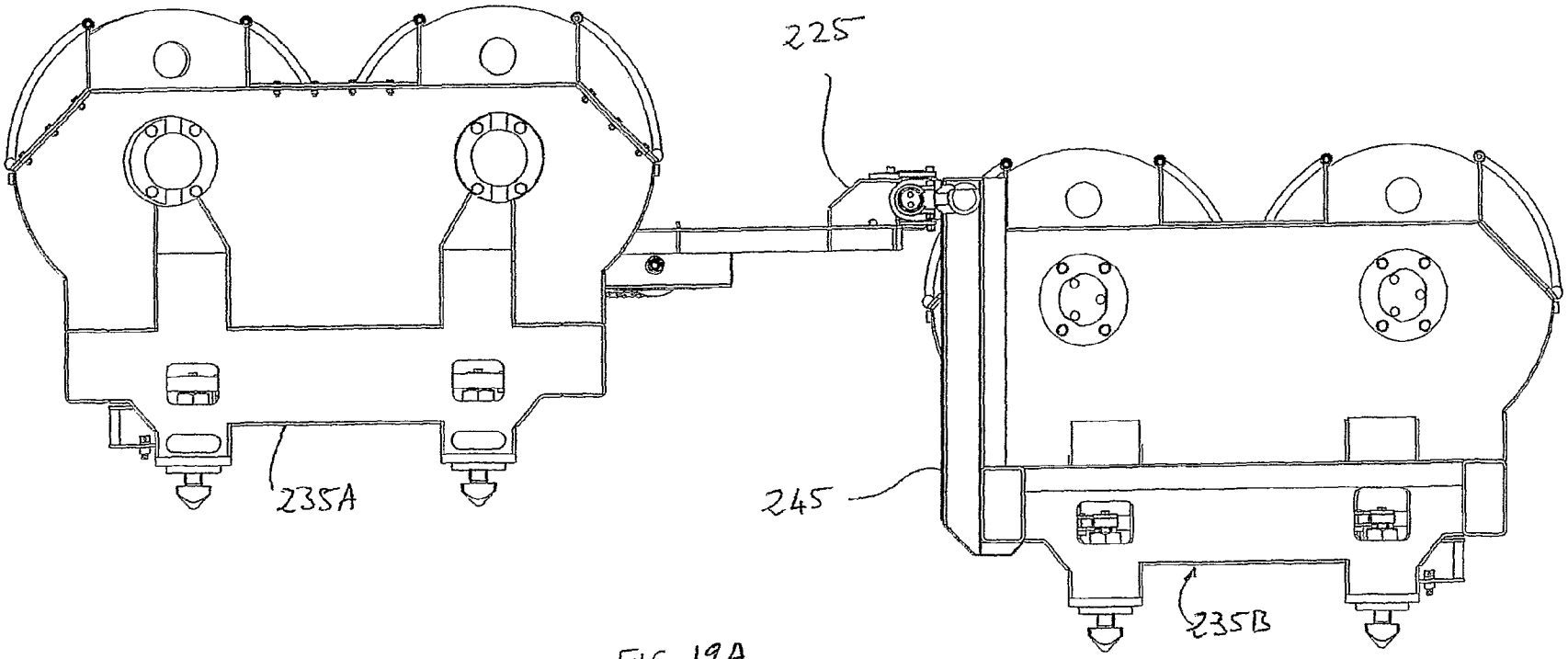
FIGS. 19A to 19D are elevation views of the engagement assembly of FIG. 12 showing relative vertical movement of adjacent head blocks.
Figure 19B:
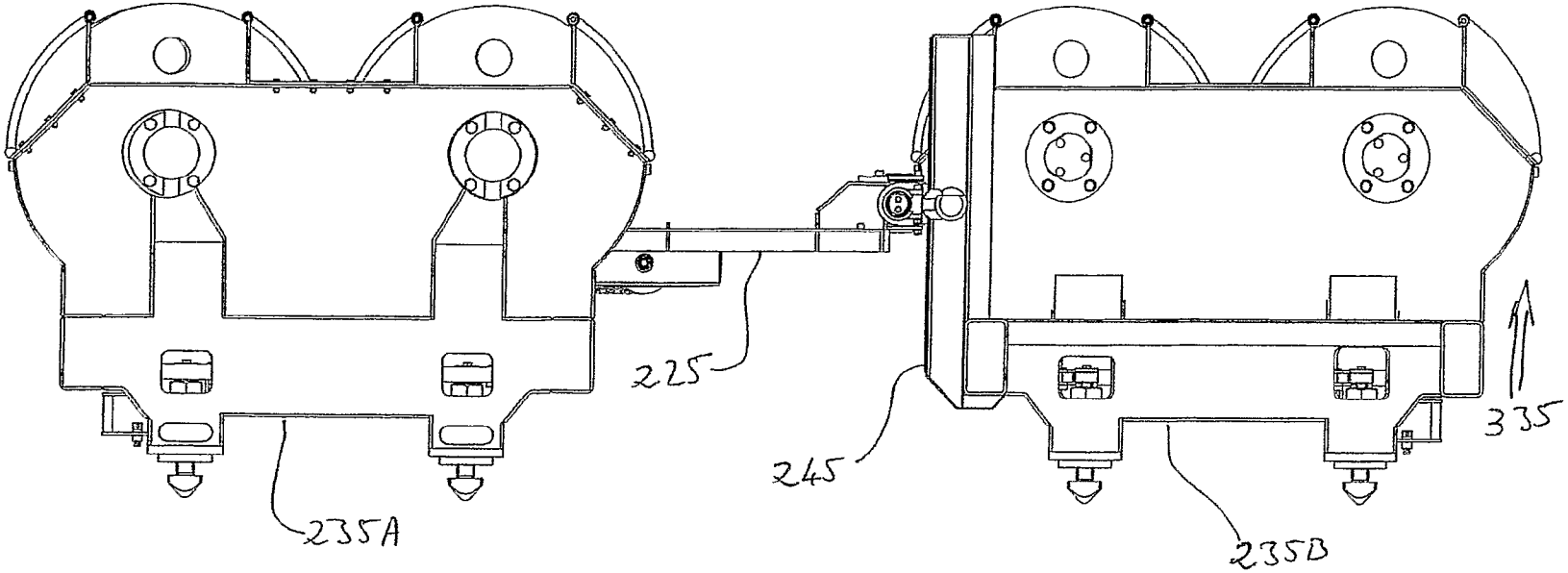
Figure 19C:
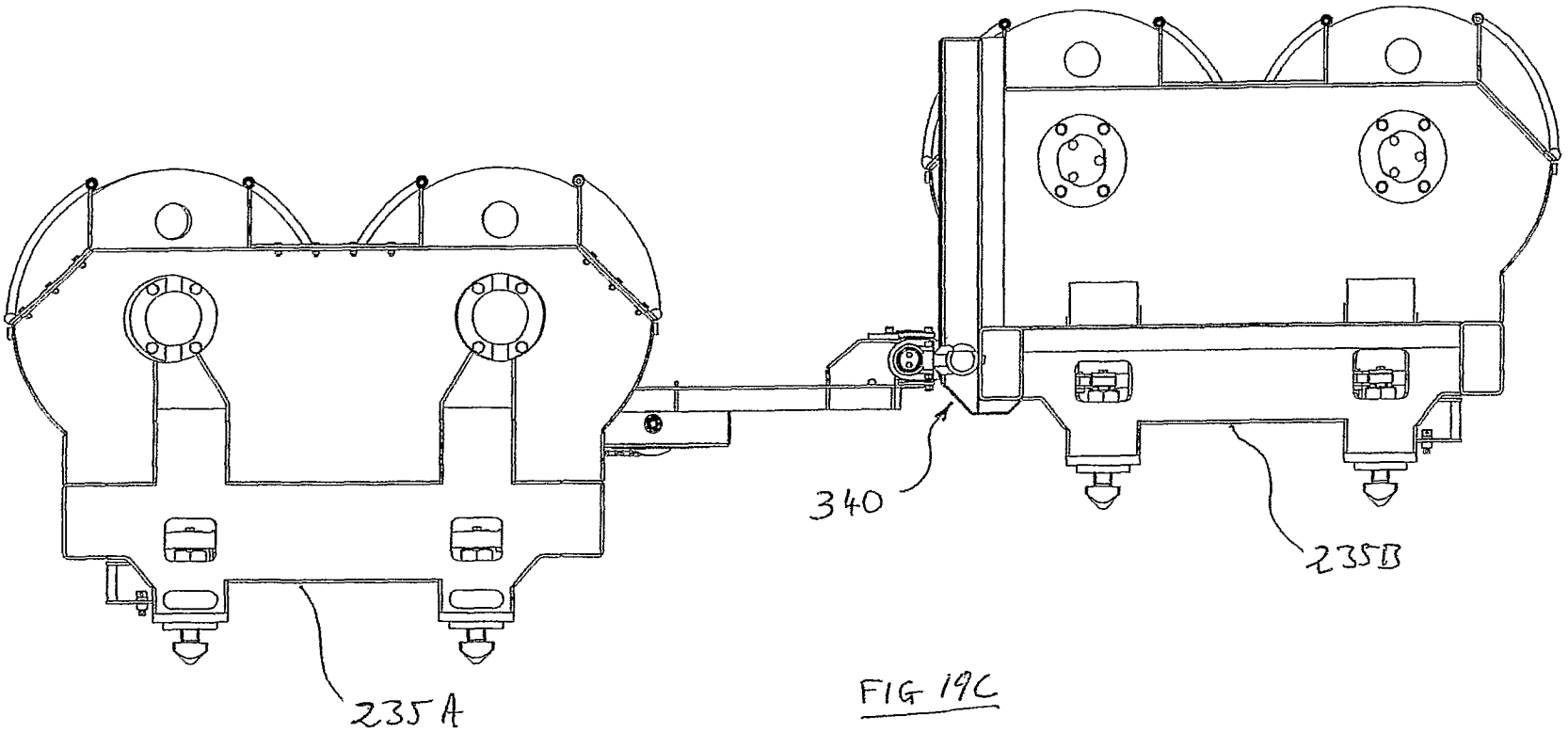
Figure 19D:
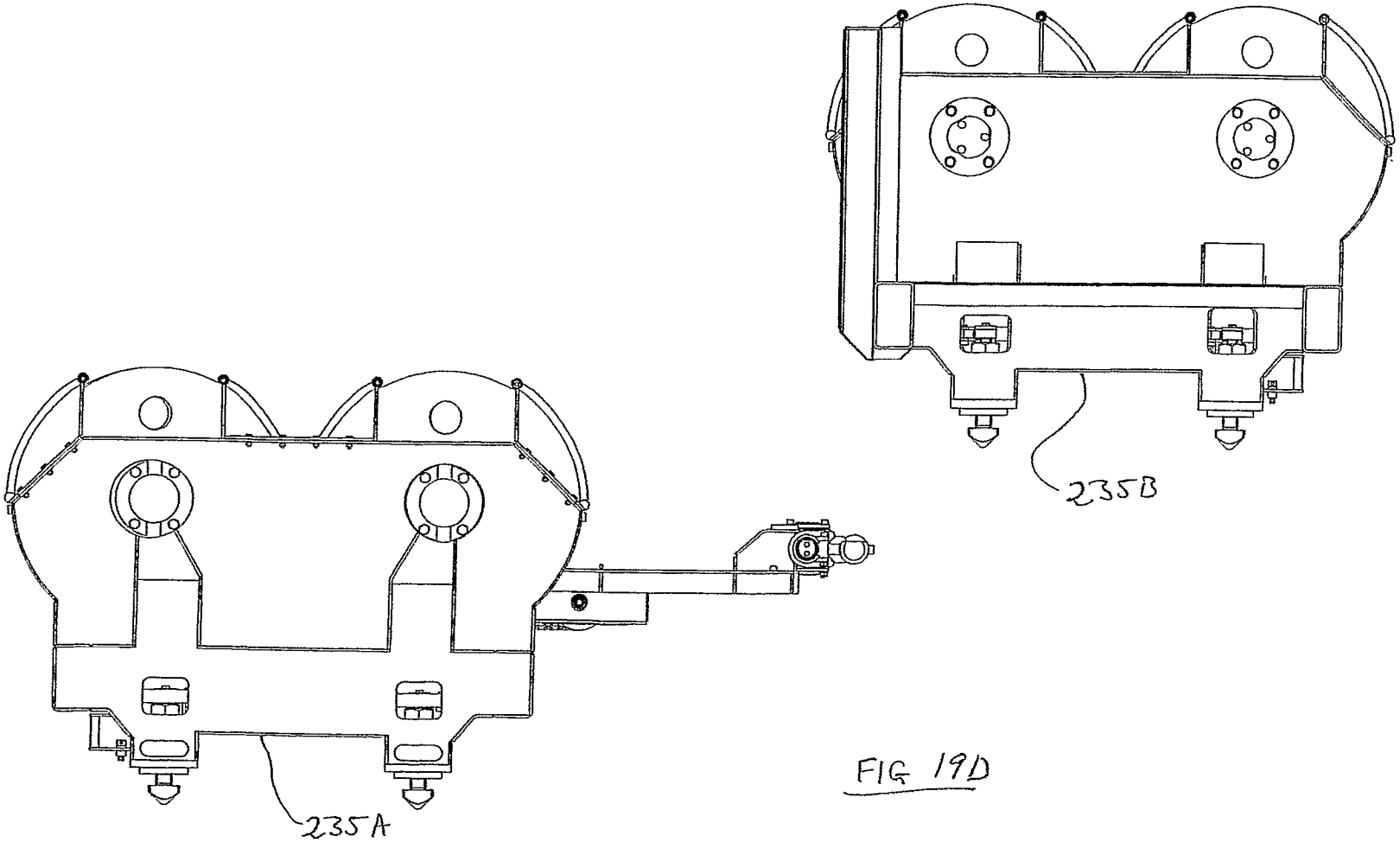

FIG. 18 shows a further function of the engagement assembly whereby the extension members 257A,B have differential extension, whereby the first extension member 257A has more fully extended than the second extension member 257B. This has the effect of rotating 230 the two head blocks relative to each other and so skewing said head blocks by a desired amount.

As mentioned previously the engagement assembly 225 has no control over the relative vertical position of the head blocks 235A, B. This is achieved by lifting or lowering the head blocks separately so as to achieve the results. FIGS. 19A to 19D show various relative positions in the vertical axis of the two head blocks starting at FIG. 19A whereby the engagement assembly 225 is located at the upper portion of the bracket 245. As the second head block 235B is raised 335, the engagement lug slide within the bracket 245 and is shown at a mid point in FIG. 19B and at a lower point 340 in FIG. 19C as the lifting of the second head block 235B progresses. As a safety measure, or merely as a more convenient way of disengaging the head blocks 235A and 235B, further lifting of the second head block 235B disengages the head blocks by permitting the engagement lug to slide out of contact with the bracket 245. Thus, if a rapid disengagement is required, all that is required is to lift, or alternatively, lower the first head block 235A to cause disengagement, thus providing a safety feature.

The invention claimed is:

1. An engagement assembly for mounting to a first head block so as to engage a second head block, said assembly comprising:

at least one mounting bracket for mounting the assembly to the first head block;

a plurality of extendable members each connected at a first end to the at least one mounting bracket, a second opposed end of each extendable member being extendable away from said first head block;

a plurality of engagement portions in communication with the second ends such that extension of the second ends consequently extends the engagement portions, said engagement portions adapted to engage engagement brackets mounted to the second head block;

a lateral engagement member connected to each of the second ends such that extension of the second ends consequently extends the lateral engagement member, said engagement portions mounted to the lateral engagement member;

said lateral engagement member adapted to extend the engagement portions in opposed directions along an axis parallel to a longitudinal axis of the first head block, and further adapted to retract the engagement portions along the same axis in order to engage engagement brackets of the second head block, wherein on engagement the engagement assembly permits selective relative movement in the horizontal plane and free relative vertical movement.

2. The assembly according to claim 1, wherein the at least one mounting bracket includes a single base from which each extendable member extends.

3. The assembly according to claim 1, wherein each extendable member has an individual base, said bases collectively forming the mounting means.

4. The assembly according to claim 1, wherein the engagement brackets include vertical rods mounted to the second head block.

5. The assembly according to claim 1, wherein each extendable member includes a linkage assembly biased by an actuator.

6. The assembly according to claim 5, wherein each said linkage assembly includes a parallelogram linkage.

7. The assembly according to claim 5, wherein said linkage assembly is arranged such that as the extendable member extends the respective second end remains in the same horizontal plane.

8. The assembly according to claim 1, wherein the lateral engagement member includes an actuation means directed in two opposed directions.

9. The assembly according to claim 8, wherein said actuation means include two actuators each acting on the respective engagement portions.

10. The assembly according to claim 8, wherein said actuation means includes a single bi-directional actuator, opposed ends of said bi-directional actuator acting on respective engagement portions.

11. The assembly according to claim 1, further including a control system adapted to automatically activate the extendable members.

12. The assembly according to claim 1, further including a control system adapted to automatically activate the extendable members, wherein said control system is further adapted to automatically activate the lateral engagement member.

13. The assembly according to claim 1, wherein the engagement portions are located adjacent opposed ends of the lateral engagement member.

14. The assembly according to claim 1, wherein the engagement portions are hook shaped members.

15. The assembly according to claim 1, wherein on engagement said engagement portions permit sliding engagement with the engagement brackets.

16. A method of engaging a first head block and a second head block, comprising the steps of:

extending a plurality of extendable arms mounted at first ends to the first head block towards the second head block, said extendable arms having second ends in communication with a plurality of engagement portions such that extension of the second ends consequently extends the engagement portions;

said engagement portions engaging engagement brackets mounted to the second head block;

the engaging step comprising the step of retracting the engagement portions in convergent directions along an axis parallel to a longitudinal axis of the first head block in order to engage the engagement brackets;

permitting selective relative movement of the head blocks in the horizontal plane and free relative vertical movement.

17. The method according to claim 16, further comprising the steps of extending the extendable arms, and selectively separating the head blocks, after the engaging step.

18. The method according to claim 16, further comprising the steps of extending at least one extendable arm whilst maintaining the position of at least one other extendable arm so as to place the head blocks in a skew relative position, after the engaging step.

19. The method according to claim 16, further comprising the steps of retracting one engagement portion and extending another engagement portion, such that movement of the engagement portions are in the same direction along the axis parallel to a longitudinal axis of the first head block, so as to place the head blocks in an offset relative position, after the engaging step.

20. An engagement assembly for mounting to a first head block so as to engage a second head block, said assembly comprising:

at least one mounting bracket for mounting the assembly to the first head block;

a plurality of telescopically extendable members each connected at a first end to the at least one mounting bracket, a second opposed end of each telescopically extendable member being extendable away from said first head block;

a plurality of engagement portions in communication with the second ends such that extension of the second ends consequently extends the engagement portions, said engagement portions adapted to engage engagement brackets mounted to the second head block, wherein on engagement, relative movement of the head blocks in the horizontal plane is subject to extension of the telescopically extendable members and relative vertical movement is independent of the telescopically extendable members.

21. The engagement assembly according to claim 20 wherein the telescopically extendable members comprise a plurality of nested sub-members in sliding engagement with adjacent sub-members.

22. The assembly according to claim 21 wherein each telescopically extendable member has a total stroke equivalent to a multiple of the stroke of the actuator, said multiple being equivalent to the number of sub-members within said telescopically extendable member.

23. The assembly according to claim 20 wherein each of the telescopically extendable members are biased by a linear actuator, said actuator being any one or a combination of: pneumatic, hydraulic or electric actuators.

24. The assembly according to claim 20 wherein the telescopically extendable members include a plurality of sub members such that adjacent sub-members are engaged through a sprocket and chain arrangement.

25. The assembly according to claim 24 wherein said adjacent sub-members extend along axes parallel to an axis of extension of said telescopically extendable members.

26. The assembly according to claim 24 wherein the chain for said sprocket and chain arrangement is driven such that adjacent sub-members are capable of relative linear movement and said chain is driven as a result of movement of the actuator.

27. The assembly according to claim 20, further comprising a lateral engagement member connected to each of the second ends such that extension of the second ends consequently extends the lateral engagement member, said engagement portions mounted to the lateral engagement member.

28. The assembly according to claim 27, wherein said lateral engagement member adapted to extend the engagement portions in opposed directions along an axis parallel to a longitudinal axis of the second head block, and further adapted to retract the engagement portions along the same axis in order to engage engagement brackets of said second head block.

29. The assembly according to claim 27, wherein the lateral engagement member includes an actuation means directed in two opposed directions.

30. The assembly according to claim 29, wherein said actuation means include two actuators each acting on the respective engagement portions.

31. The assembly according to claim 29, wherein said actuation means includes a single bi-directional actuator, opposed ends of said bi-directional actuator acting on respective engagement portions.

32. The assembly according to claim 27, further comprising a control system adapted to automatically activate the telescopically extendable members, wherein said control system is further adapted to automatically activate the lateral engagement member.

33. The assembly according to claim 27, wherein the engagement portions are located adjacent opposed ends of the lateral engagement member.

34. The assembly according to claim 20, wherein the at least one mounting bracket includes a single base from which each telescopically extendable member extends.

35. The assembly according to claim 20, wherein each telescopically extendable member has an individual base, said bases collectively forming a mounting means.

36. The assembly according to claim 20, wherein the engagement brackets include brackets mounted to the second head block, said brackets including vertically arranged channels.

37. The assembly according to claim 36, wherein the engagement portions include lugs adapted to fit and slide within said channels.

38. The assembly according to claim 20, further comprising a control system adapted to automatically activate the telescopically extendable members.

39. A method of engaging a first head block and a second head block, comprising the steps of:

extending a plurality of telescopically extendable arms mounted at first ends to the first head block towards the second head block, said telescopically extendable arms having second ends in communication with a plurality of engagement portions such that extension of the second ends consequently extends the engagement portions;

said engagement portions engaging engagement brackets mounted to the second head block;

permitting selective relative movement of the head blocks in the horizontal plane and free relative vertical movement.

40. The method according to claim 39, wherein the engaging step comprises the step of retracting the engagement portions in convergent directions along an axis parallel to a longitudinal axis of the first head block in order to engage the engagement brackets.

41. The method according to claim 39, further comprising the steps of extending the telescopically extendable arms, and selectively separating the head blocks, after the engaging step.

42. The method according to claim 39 further comprising the steps of extending at least one telescopically extendable arm whilst maintaining the position of at least one other telescopically extendable arm so as to place the head blocks in a skew relative position, after the engaging step.

43. The method according to claim 42 further comprising the steps of retracting one engagement portion and extending another engagement portion, such that movement of the engagement portions are in the same direction along the axis parallel to a longitudinal axis of the first head block, so as to place the head blocks in an offset relative position, after the engaging step.

* * * * *

UNITED STATES PATENT AND TRADEMARK OFFICE

CERTIFICATE OF CORRECTION

PATENT NO. : 8,469,420 B2
APPLICATION NO. : 12/301943
DATED : June 25, 2013
INVENTOR(S) : Mills et al.

It is certified that error appears in the above-identified patent and that said Letters Patent is hereby corrected as shown below:

ON THE TITLE PAGE:

Item (73), delete "Robert Arthur Mills, Lancashire (GB)" and insert --NSL Engineering PTE LTD (Singapore, Singapore)-- therefor.

Signed and Sealed this
Twenty-second Day of April, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,469,420 B2
APPLICATION NO. : 12/301943
DATED : June 25, 2013
INVENTOR(S) : Mills et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1158 days.

Signed and Sealed this
Eighth Day of September, 2015

Michelle K. Lee

Michelle K. Lee
*Director of the United States Patent and Trademark Office*